US011788818B2

(12) United States Patent
Roth

(10) Patent No.: US 11,788,818 B2
(45) Date of Patent: Oct. 17, 2023

(54) FIREARM SIGHT MOUNT AND METHODS AND USES THEREOF

(71) Applicant: Core-Arms, LLC, Irvine, CA (US)

(72) Inventor: David Roth, Mission Viejo, CA (US)

(73) Assignee: Core-Arms, LLC, Irvine, CA (US)

( * ) Notice: Subject to any disclaimer, the term of this patent is extended or adjusted under 35 U.S.C. 154(b) by 0 days.

(21) Appl. No.: 17/633,189

(22) PCT Filed: Aug. 5, 2020

(86) PCT No.: PCT/US2020/045067

§ 371 (c)(1),
(2) Date: Feb. 5, 2022

(87) PCT Pub. No.: WO2021/040978

PCT Pub. Date: Mar. 4, 2021

(65) Prior Publication Data

US 2022/0268553 A1 Aug. 25, 2022

Related U.S. Application Data

(60) Provisional application No. 62/882,872, filed on Aug. 5, 2019.

(51) Int. Cl.
*F41G 11/00* (2006.01)
*F41G 1/30* (2006.01)

(52) U.S. Cl.
CPC ..... *F41G 11/001* (2013.01); *F41G 1/30* (2013.01)

(58) Field of Classification Search
CPC . F41G 11/001; F41G 1/30; F41G 1/02; F41G 1/06; F41G 1/26; F41G 1/28; F41G 1/38; F41G 1/387
See application file for complete search history.

(56) References Cited

U.S. PATENT DOCUMENTS 4,628,611 A * 12/1986 Ruffino ..... F41G 1/16 42/137
4,862,624 A 9/1989 Williams
4,890,407 A 1/1990 Nichols
5,563,362 A 10/1996 York
6,327,806 B1 * 12/2001 Paige ..... F41G 1/30 42/130
6,418,657 B1 7/2002 Brown
D533,547 S * 12/2006 Sergi ..... D8/354
D542,628 S * 5/2007 Brassard ..... D8/354
7,240,451 B2 * 7/2007 Blair ..... F41G 11/003 42/124

(Continued)

FOREIGN PATENT DOCUMENTS

AT 519569 B1 8/2018

OTHER PUBLICATIONS

WIPO, PCT Form ISA210, International Search Report for International Patent Application Serial No. PCT/2020/045067, pp. 4 (dated Feb. 10, 2021).

(Continued)

*Primary Examiner* — Joshua E Freeman

(74) *Attorney, Agent, or Firm* — UltimatEdge IP Law Group, P.C.; Dean G. Stathakis

(57) ABSTRACT

The present specification discloses a sight mount used to attach or otherwise secure an optical sight to a firearm as well as methods of modifying a firearm to receive a sight mount disclosed herein.

19 Claims, 17 Drawing Sheets

(56) References Cited

U.S. PATENT DOCUMENTS

| | | | | |
|---|---|---|---|---|
| D559,083 | S * | 1/2008 | Brassard | D8/354 |
| D571,188 | S * | 6/2008 | Brassard | D8/354 |
| D619,195 | S * | 7/2010 | Bengtsson | D22/110 |
| 8,769,859 | B2 | 7/2014 | Li et al. | |
| 8,832,983 | B1 * | 9/2014 | Wolf | F41G 1/00 42/76.01 |
| D802,697 | S * | 11/2017 | Dueck | D22/108 |
| 9,863,740 | B2 * | 1/2018 | Wolf | F41G 1/26 |
| 9,869,531 | B1 | 1/2018 | Zimmer | |
| 10,024,628 | B2 * | 7/2018 | Toner | F41G 1/16 |
| 10,088,275 | B1 * | 10/2018 | Warren | F41G 1/02 |
| D832,970 | S * | 11/2018 | Jen | D22/108 |
| D848,821 | S * | 5/2019 | Cook | D8/354 |
| D849,179 | S * | 5/2019 | Staes | D22/109 |
| D851,196 | S * | 6/2019 | Chester | D22/108 |
| 10,563,955 | B2 * | 2/2020 | Pniel | F41G 1/16 |
| D898,157 | S * | 10/2020 | Roth | D22/110 |
| 10,976,127 | B2 * | 4/2021 | Adika | F41C 27/00 |
| 11,112,214 | B2 * | 9/2021 | Niswander | F41G 1/16 |
| 11,131,526 | B2 * | 9/2021 | Shawley | F41G 1/06 |
| 2014/0230305 | A1 * | 8/2014 | Zimmer | F41C 3/00 42/111 |
| 2015/0241175 | A1 * | 8/2015 | Wolf | F41G 11/005 42/124 |
| 2015/0268002 | A1 * | 9/2015 | Jeung | F41G 1/30 42/71.02 |
| 2017/0059277 | A1 * | 3/2017 | Justice | F41G 11/003 |
| 2017/0184375 | A1 * | 6/2017 | Huff | F41G 11/003 |
| 2018/0195835 | A1 * | 7/2018 | Crispin | F41G 1/30 |
| 2019/0257620 | A1 * | 8/2019 | Zimmer | F41C 3/00 |
| 2019/0331461 | A1 * | 10/2019 | Zimmer | F41G 1/17 |
| 2020/0025520 | A1 * | 1/2020 | Niswander | F41G 11/00 |

OTHER PUBLICATIONS

WIPO, PCT Form ISA237, Written Opinion for International Patent Application Serial No. PCT/US2020/045067, pp. 7 (dated Feb. 20, 2021).

* cited by examiner

FIREARM SIGHT MOUNT AND METHODS AND USES THEREOF

This application is a 35 U.S.C. § 371 U.S. national stage patent application which claims the benefit of priority and is entitled to the filing date of International Patent Application PCT/US2020/045067, filed Aug. 5, 2020, an international patent application which claims the benefit of priority and is entitled to the filing date pursuant to 35 U.S.C. § 119 (e) of U.S. Provisional Patent Application Ser. No. 62/882,872, filed Aug. 5, 2019, the content of each of which is hereby incorporated by reference in its entirety.

A firearm, such as a rifle or handgun, typically includes sights, an aiming device that assists in visually aligning the firearm with the intended target to facilitate a more accurate aiming of the firearm. A manufacturer typically produces and distributes a firearm with iron sights, a system of shaped alignment markers which generally consist of a front post and a rear notch. While iron sights are effective, more sophisticated sighting systems are available which enhance the accuracy and/or effective aiming distance of a firearm. For example, optical sights provide an simple sight image of a single aiming point or pattern (reticle) superimposed on the field of view at the same focal point as the target. This single aiming point design is more accurate, easier to use, and increases target acquisition speed compared to the duel front post/rear notch arrangement of an iron sight. In addition, optical sights can effectively operate under environmental conditions that make target acquisition using iron sights difficult or impossible to achieve. For example, an optical sight with illuminated aiming point can effective aim a firearm toward a target in low light conditions; visual alignment of iron sights under such conditions are problematic. Due to the increase performance achieved using an optical sight, it is most desirous and advantageous to exchange the iron sights of a firearm with an optical sight.

However, given the design of most handguns, attaching an optical sight can be difficult to achieve. In order to accommodate an optical sight, a slide of a handgun typically needs to be permanently modified in order to receive an optical sight. However, such handgun modification can result in deleterious consequences. For example, such modifications can leave the internal components of a handgun exposed to dust and/or moisture, which can lead to a mechanical failure or deterioration of one or more internal components due to this environmental harm. In addition, modification of a handgun to receive an optical sight must consider the mechanical forces and strain place on the optical sight that may reduce service life, such as the rapid acceleration and deceleration of a slide during operation (e.g., firing). Furthermore, weight added to a handgun due to attachment of an optical sight and any modifications necessary for a handgun to receive an optical sight can detrimentally affect operation, performance and usability of a handgun. As such, there needs to be a means to properly secure an optical sight to a handgun which accounts of these and other potential deleterious consequences.

The present sight mount and method to modify a firearm to attach a sight mount disclosed herein address the concerns raised above.

SUMMARY

Aspects of the present specification disclose a sight mount for a firearm. The disclosed sight mount can be rectangular in shape with length, width and height dimensions and can comprises a top surface, the top surface comprising two slide mount holes, two sight mount holes and weight-reducing depressions; a bottom surface, the bottom surface comprising weight-reducing depressions and being conformed to the contours of an area of the firearm where the sight mount will be secured, a front side and a rear side, the front and the rear surfaces both having a curvilinear bottom edge conforming to the contours of an area of the firearm where the sight mount will be secured; a right side and a left side. The two slide mount holes of a disclosed sight mount can be located in parallel to each other and aligned on a central axis bisecting the sight mount and parallel to the right side. In aspects, the two slide mount holes can be about 9 mm to about 15 mm apart from each other. The two sight mount holes of a disclosed sight mount can be located in parallel to each other along an axis running parallel to the rear side. In aspects, the two sight mount holes can be about 4 mm to about 10 mm apart from each other.

Other aspects of the present specification disclose a method of modifying a firearm to receive a slide mount disclosed herein. The disclosed method can comprise a) removing a ledge or a portion thereof from a slide; b) modifying a slide by drilling and tapping two slide mount screw holes; and c) modifying a slide housing by drilling holes for the slide mount holes and sight mount holes, wherein steps (a) to (c) can be performed in any order. A disclosed method can further comprise, prior to steps (a) to (c), disassembling a firearm to remove rear iron sight and associated components from a slide. A disclosed method can further comprise, after steps (a) to (c), securing the sight mount to the modified slide. A disclosed method can further comprise, after the sight mount is secured, reassembling the firearm, and after the firearm is reassembled, securing a sight to the sight mount. The sight is an optical sight, including, without limitation, a laser sight. A firearm disclosed herein can be a rifle or a handgun.

BREIF DESCRIPTION OF THE DRAWINGS

DETAILED DESCRIPTION

Figure 1:
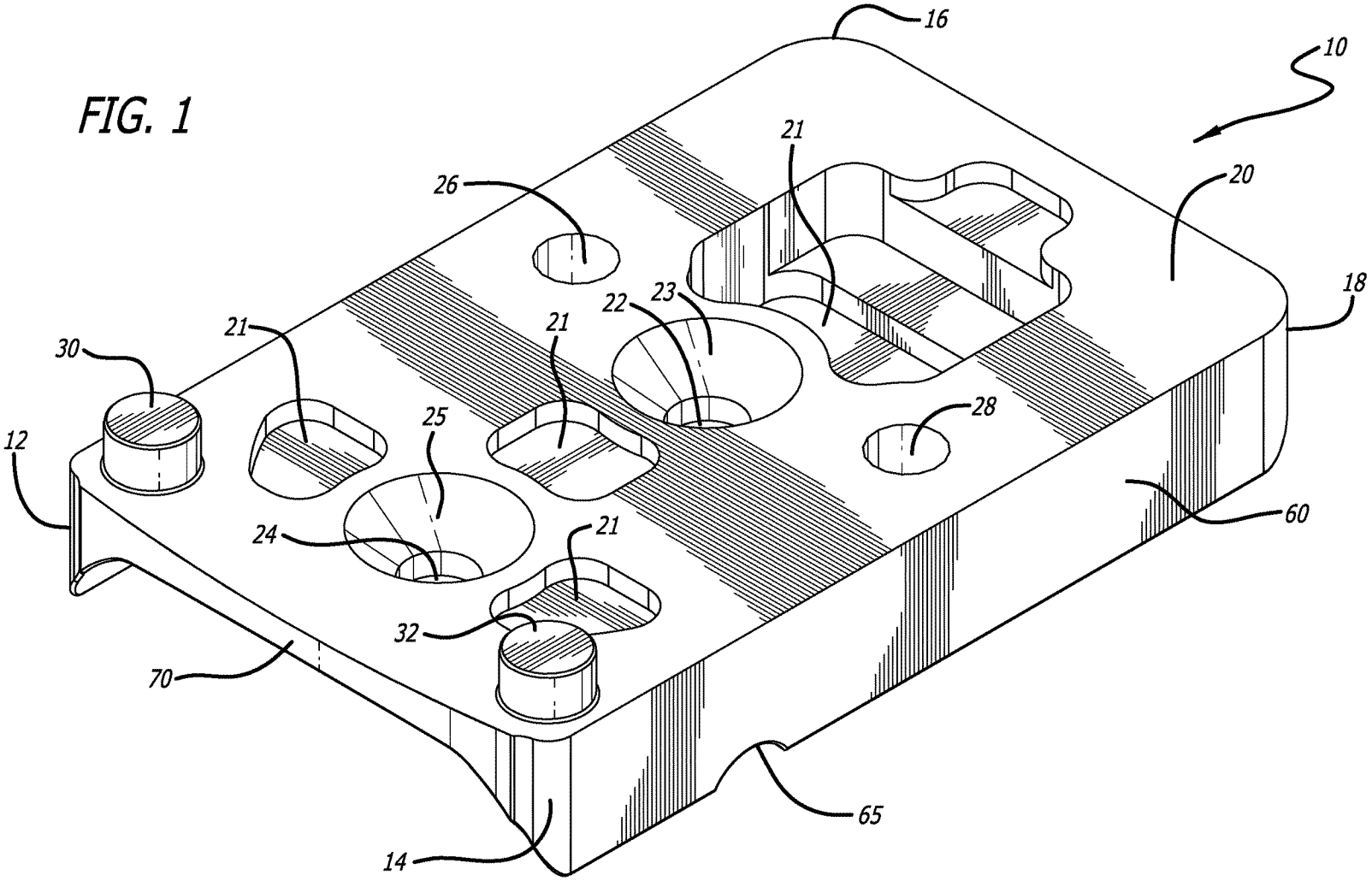
FIG. 1 is a top front perspective view an exemplary embodiment a sight mount disclosed herein for a firearm.

Disclosed herein is a sight mount used to attach or otherwise secure an optical sight to a firearm as well as methods of modifying a firearm to receive a sight mount disclosed herein.

A firearm includes a rifle and a handgun. A rifle is a portable, long-barreled firearm that is designed to be held and used with both hands and typically braced against the shoulder for stability during firing. A rifle can be a single-shot, a manual repeating shot or a self-loading repeating shot firearm. A rifle includes without limitation, a breech-loading rifle, a lever-action rifle, a pump-action rifle, a bolt-action rifle, a semi-automatic rifle and an automatic rifle.

A handgun is a portable, short-barreled firearm designed to be held and used with one hand during firing. A handgun can be a single-shot, a manual repeating shot or a self-loading repeating shot firearm. A handgun includes without limitation, a pistol, a revolver, a semi-automatic pistol, and a machine pistol.

An optical sight is an aiming device that provides an simple sight image of a single aiming point or pattern (reticle) superimposed on the field of view at the same focal point as the target. An optical sight can be a non-magnifying optical device or a magnifying optical device. Examples of optical sights include, without limitation, a telescopic sight, a reflector sight, a collimator sight, a holographic weapon sight and a laser sight.

Aspects of the present specification disclose a sight mount. A sight mount disclosed herein functions to secure a sight to a firearm. In an embodiment, a sight mount disclosed herein comprises two or more mounting holes that are aligned in a direction parallel to the recoil direction of the slide. The positioning of these mounting holes provide a more secure attachment of the sight mount to the firearm. This improved attachment enables a sight mount disclosed herein to be manufactured in a more light-weight fashion without any sacrifice in durability, structural integrity or performance to the sight mount. In addition, the lighter weight of a sight mount disclosed herein facilitates better operation and improved overall performance of a firearm, thereby increasing target acquisition and accuracy. Furthermore, the form-fitting nature of a slide mount disclosed herein enables a dust-resistant and water-resistant seal between a sight mount disclosed herein and one or more internal components of a firearm to further improve performance by preventing jamming or other mechanical failure and protecting internal components from rusting or other forms of environmental harm.

A sight mount disclosed herein is made from light-weight metals or metal alloys. In one embodiment, a light-weight metal or metal alloy is hardened metal or metal alloy or a tempered metal or metal alloy. In one embodiment, a sight mount disclosed herein is made from harden aluminum. In an aspect of this embodiment, a harden aluminum is an aluminum harden to T6.

A sight mount disclosed herein is generally polygonal in shape and generally conforms to the shape of a surface area of a firearm designated to receive the sight mount. In aspects of this embodiment, a sight mount disclosed herein can be triangular, square, rectangular, or pentagonal in shape. However, any shape that enables proper attachment of a sight mount disclosed herein to a firearm and an optical sight to a sight mount disclosed herein is acceptable. In one embodiment, a sight mount disclosed herein is rectangular in shape with the length of a sight mount longer than its width.

In one embodiment, sight mount disclosed herein a length. In aspects of this embodiment, a sight mount disclosed herein each have a length of, e.g., about 25 mm, about 30 mm, about 35 mm, about 40 mm, about 45 mm, or about 50 mm. In other aspects of this embodiment, a sight mount disclosed herein each have a length of, e.g., at least 25 mm, at least 30 mm, at least 35 mm, at least 40 mm, at least 45 mm, or at least 50 mm. In yet other aspects of this embodiment, a sight mount disclosed herein each have a length of, e.g., at most 25 mm, at most 30 mm, at most 35 mm, at most 40 mm, at most 45 mm, or at most 50 mm. In still other aspects of this embodiment, a sight mount disclosed herein each have a length of, e.g., about 25 mm to about 30 mm, about 25 mm to about 35 mm, about 25 mm to about 40 mm, about 25 mm to about 45 mm, about 25 mm to about 50 mm, about 30 mm to about 35 mm, about 30 mm to about 40 mm, about 30 mm to about 45 mm, about 30 mm to about 50 mm, about 35 mm to about 40 mm, about 35 mm to about 45 mm, about 35 mm to about 50 mm, about 40 mm to about 45 mm, about 40 mm to about 50 mm, or about 45 mm to about 50 mm.

In one embodiment, sight mount disclosed herein a width. In aspects of this embodiment, a sight mount disclosed herein each have a width of, e.g., about 15 mm, about 20 mm, about 25 mm, about 30 mm, or about 35 mm. In other aspects of this embodiment, a sight mount disclosed herein each have a width of, e.g., at least 15 mm, at least 20 mm, at least 25 mm, at least 30 mm, or at least 35 mm. In yet other aspects of this embodiment, a sight mount disclosed herein each have a width of, e.g., at most 15 mm, at most 20 mm, at most 25 mm, at most 30 mm, or at most 35 mm. In still other aspects of this embodiment, a sight mount disclosed herein each have a width of, e.g., about 15 mm to about 20 mm, about 15 mm to about 25 mm, about 15 mm to about 30 mm, about 15 mm to about 35 mm, about 20 mm to about 25 mm, about 20 mm to about 30 mm, about 20 mm to about 35 mm, about 25 mm to about 30 mm, about 25 mm to about 35 mm, or about 30 mm to about 35 mm.

In one embodiment, sight mount disclosed herein a height. A height of a front side disclosed herein is the distance between a top edge and a bottom edge of the front side. A height of a rear side disclosed herein is the distance between a front edge and a bottom edge of the rear side. A front side and a rear side can be any height so long as each height adequately supports a top surface of a sight mount disclosed herein. In one embodiment, front side and a left side of a sight mount disclosed herein are equal in height. In one embodiment, a front and a rear side follow the contours of an area of a FN 5.7 handgun where a sight mount disclosed herein is to be installed, such as, e.g., FN 5.7 Mark I handgun or FN 5.7 Mark II handgun.

Since a sight mount disclosed herein conforms to the contours of an area of a firearm where a sight mount disclosed herein is to be installed, the overall bottom is curvilinear and thus the height can vary depending on where the measurement will be taken. As such, height measurements for a sight mount disclosed herein need to be defined at specific positions, such as for example midpoint of a front or a rear side and/or a right-side edge or a left-side edge of a front side or a rear side or midpoint of a right side or a left side.

In aspects of this embodiment, a sight mount disclosed herein has a height at the midpoint of a front side or a rear side of, e.g., about 1 mm, about 1.5 mm, about 2 mm, about 2.5 mm, about 3 mm, about 3.5 mm, about 4 mm, about 4.5 mm, or about 5 mm. In other aspects of this embodiment, a sight mount disclosed herein has a height at the midpoint of a front side or a rear side of, e.g., at least 1 mm, at least 1.5 mm, at least 2 mm, at least 2.5 mm, at least 3 mm, at least 3.5 mm, at least 4 mm, at least 4.5 mm, or at least 5 mm. In yet other aspects of this embodiment, a sight mount disclosed herein has a height at the midpoint of a front side or a rear side of, e.g., at most 1 mm, at most 1.5 mm, at most 2 mm, at most 2.5 mm, at most 3 mm, at most 3.5 mm, at most 4 mm, at most 4.5 mm, or at most 5 mm. In still other aspects of this embodiment, a sight mount disclosed herein has a height at the midpoint of a front side or a rear side of, e.g., about 1 mm to about 2 mm, about 1 mm to about 3 mm, about 1 mm to about 4 mm, about 1 mm to about 5 mm, about 2 mm to about 3 mm, about 2 mm to about 4 mm, about 2 mm to about 5 mm, about 3 mm to about 4 mm, about 3 mm to about 5 mm, or about 4 mm to about 5 mm.

In aspects of this embodiment, a sight mount disclosed herein has a height at a right-side and/or a left-side of a front side or a rear side of, e.g., about 2 mm, about 2.5 mm, about 3 mm, about 3.5 mm, about 4 mm, about 4.5 mm, about 5 mm, about 5.5 mm, about 6 mm, about 6.5 mm, about 7 mm, about 7.5 mm, about 8 mm, about 8.5 mm, about 9 mm, about 9.5 mm, or about 10 mm. In other aspects of this embodiment, a sight mount disclosed herein has a height at a right-side and/or a left-side of a front side or a rear side of, e.g., at least 2 mm, at least 2.5 mm, at least 3 mm, at least 3.5 mm, at least 4 mm, at least 4.5 mm, at least 5 mm, at least 5.5 mm, at least 6 mm, at least 6.5 mm, at least 7 mm, at least 7.5 mm, at least 8 mm, at least 8.5 mm, at least 9 mm, at least 9.5 mm, or at least 10 mm. In yet other aspects of this embodiment, a sight mount disclosed herein has a height at a right-side and/or a left-side of a front side or a rear side of, e.g., at most 2 mm, at most 2.5 mm, at most 3 mm, at most 3.5 mm, at most 4 mm, at most 4.5 mm, at most 5 mm, at most 5.5 mm, at most 6 mm, at most 6.5 mm, at most 7 mm, at most 7.5 mm, at most 8 mm, at most 8.5 mm, at most 9 mm, at most 9.5 mm, or at most 10 mm. In still other aspects of this embodiment, a sight mount disclosed herein has a height at a right-side and/or a left-side of a front side or a rear side of, e.g., about 2 mm to about 3 mm, about 2 mm to about 4 mm, about 2 mm to about 5 mm, about 2 mm to about 6 mm, about 2 mm to about 7 mm, about 2 mm to about 8 mm, about 2 mm to about 9 mm, about 2 mm to about 10 mm, about 3 mm to about 4 mm, about 3 mm to about 5 mm, about 3 mm to about 6 mm, about 3 mm to about 7 mm, about 3 mm to about 8 mm, about 3 mm to about 9 mm, about 3 mm to about 10 mm, about 4 mm to about 5 mm, about 4 mm to about 6 mm, about 4 mm to about 7 mm, about 4 mm to about 8 mm, about 4 mm to about 9 mm, about 4 mm to about 10 mm, about 5 mm to about 6 mm, about 5 mm to about 7 mm, about 5 mm to about 8 mm, about 5 mm to about 9 mm, about 5 mm to about 10 mm, about 6 mm to about 7 mm, about 6 mm to about 8 mm, about 6 mm to about 9 mm, about 6 mm to about 10 mm, about 7 mm to about 8 mm, about 7 mm to about 9 mm, about 7 mm to about 10 mm, about 8 mm to about 9 mm, about 8 mm to about 10 mm, or about 9 mm to about 10 mm.

In aspects of this embodiment, a sight mount disclosed herein has a height at the midpoint of a right side or a left side of, e.g., about 2 mm, about 2.5 mm, about 3 mm, about 3.5 mm, about 4 mm, about 4.5 mm, about 5 mm, about 5.5 mm, about 6 mm, about 6.5 mm, about 7 mm, about 7.5 mm, about 8 mm, about 8.5 mm, about 9 mm, about 9.5 mm, or about 10 mm. In other aspects of this embodiment, a sight mount disclosed herein has a height at the midpoint of a right side or a left side of, e.g., at least 2 mm, at least 2.5 mm, at least 3 mm, at least 3.5 mm, at least 4 mm, at least 4.5 mm, at least 5 mm, at least 5.5 mm, at least 6 mm, at least 6.5 mm, at least 7 mm, at least 7.5 mm, at least 8 mm, at least 8.5 mm, at least 9 mm, at least 9.5 mm, or at least 10 mm. In yet other aspects of this embodiment, a sight mount disclosed herein has a height at the midpoint of a right side or a left side of, e.g., at most 2 mm, at most 2.5 mm, at most 3 mm, at most 3.5 mm, at most 4 mm, at most 4.5 mm, at most 5 mm, at most 5.5 mm, at most 6 mm, at most 6.5 mm, at most 7 mm, at most 7.5 mm, at most 8 mm, at most 8.5 mm, at most 9 mm, at most 9.5 mm, or at most 10 mm. In still other aspects of this embodiment, a sight mount disclosed herein has a height at the midpoint of a right side or a left side of, e.g., about 2 mm to about 3 mm, about 2 mm to about 4 mm, about 2 mm to about 5 mm, about 2 mm to about 6 mm, about 2 mm to about 7 mm, about 2 mm to about 8 mm, about 2 mm to about 9 mm, about 2 mm to about 10 mm, about 3 mm to about 4 mm, about 3 mm to about 5 mm, about 3 mm to about 6 mm, about 3 mm to about 7 mm, about 3 mm to about 8 mm, about 3 mm to about 9 mm, about 3 mm to about 10 mm, about 4 mm to about 5 mm, about 4 mm to about 6 mm, about 4 mm to about 7 mm, about 4 mm to about 8 mm, about 4 mm to about 9 mm, about 4 mm to about 10 mm, about 5 mm to about 6 mm, about 5 mm to about 7 mm, about 5 mm to about 8 mm, about 5 mm to about 9 mm, about 5 mm to about 10 mm, about 6 mm to about 7 mm, about 6 mm to about 8 mm, about 6 mm to about 9 mm, about 6 mm to about 10 mm, about 7 mm to about 8 mm, about 7 mm to about 9 mm, about 7 mm to about 10 mm, about 8 mm to about 9 mm, about 8 mm to about 10 mm, or about 9 mm to about 10 mm.

Figure 4:
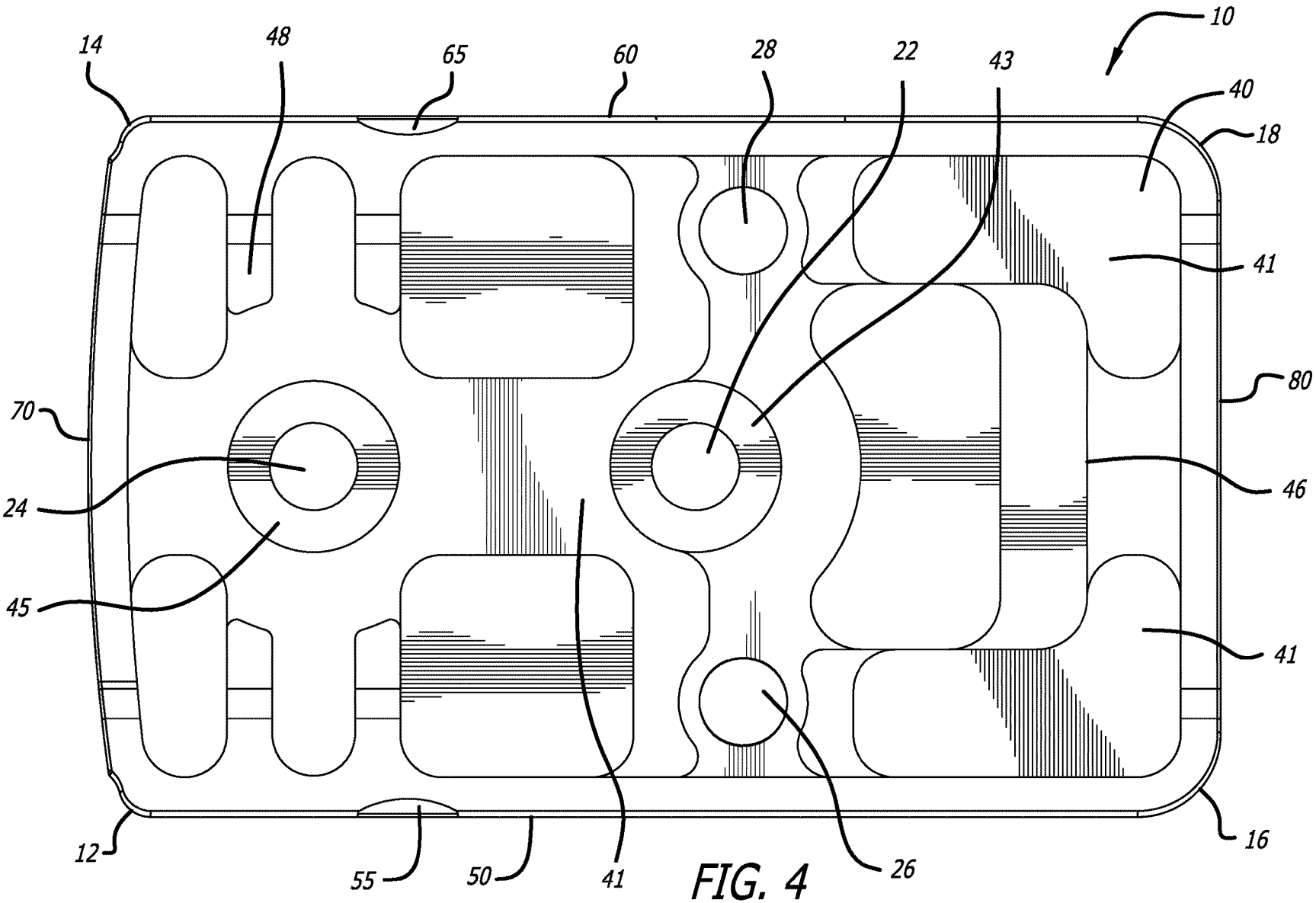
FIG. 4 is a bottom plan view of a sight mount disclosed herein.
Figure 5:
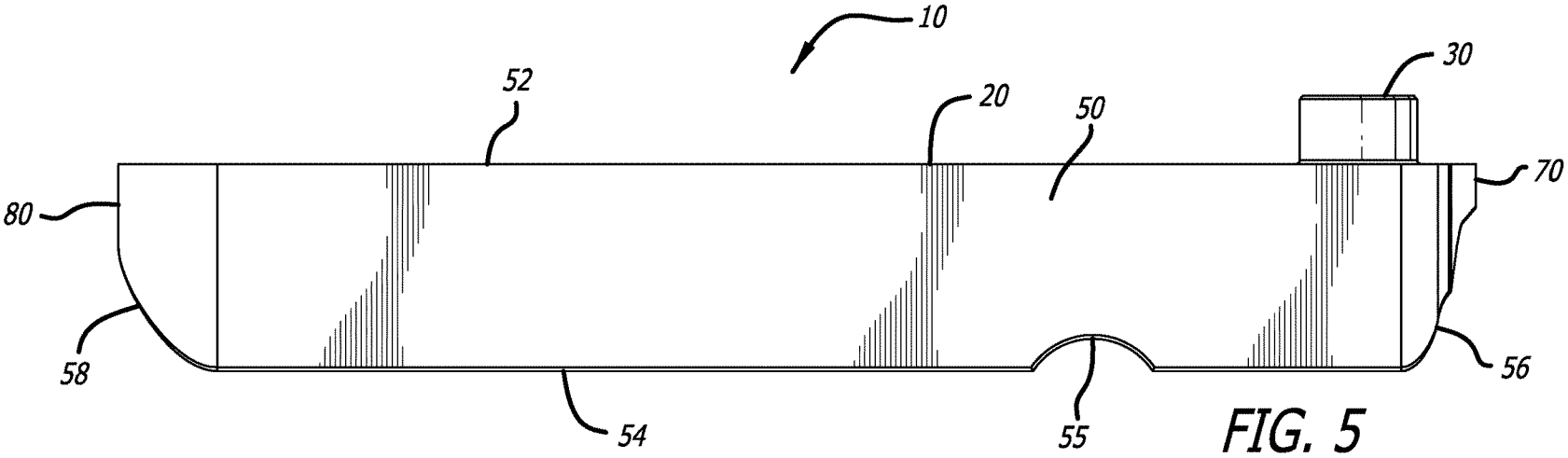
FIG. 5 is a right-side plan view of a sight mount disclosed herein.
Figure 6:
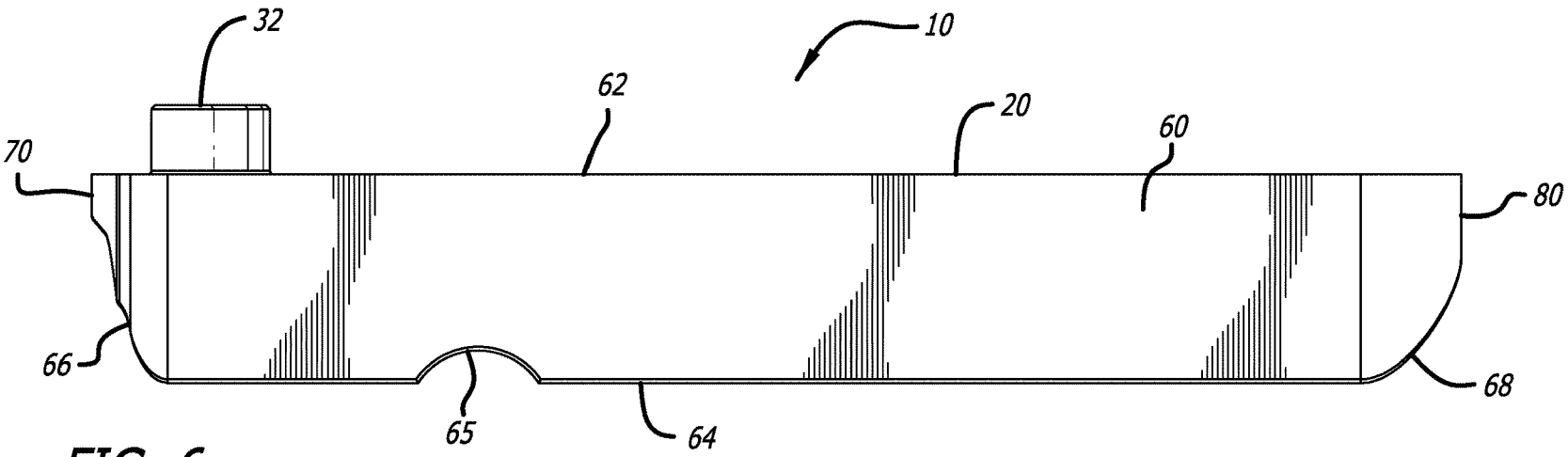
FIG. 6 is a left-side plan view of a sight mount disclosed herein.
Figure 7:
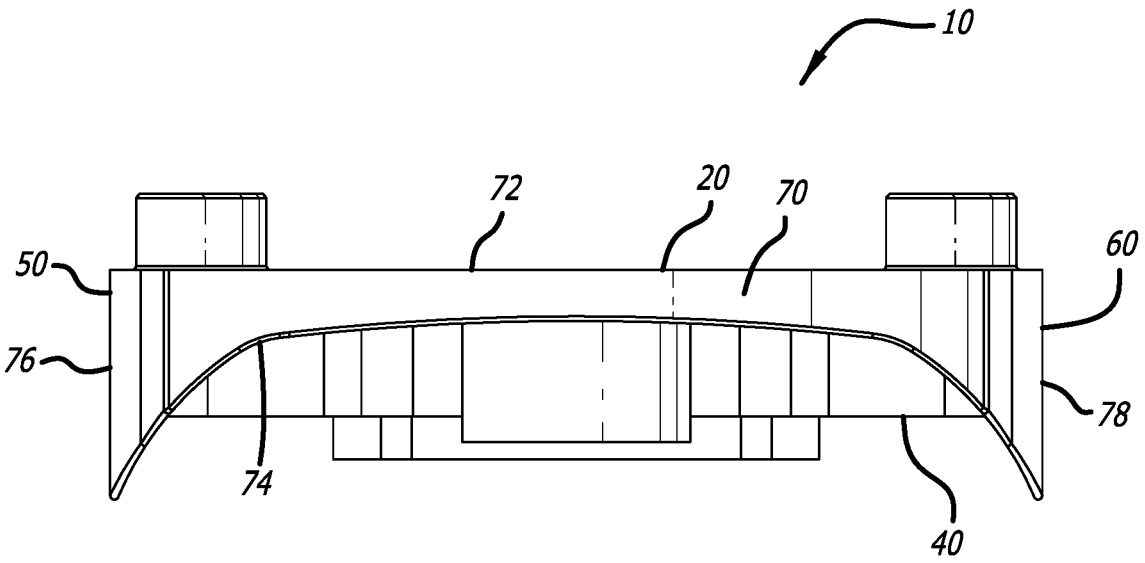
FIG. 7 is a front plan view of a sight mount disclosed herein.
Figure 8:
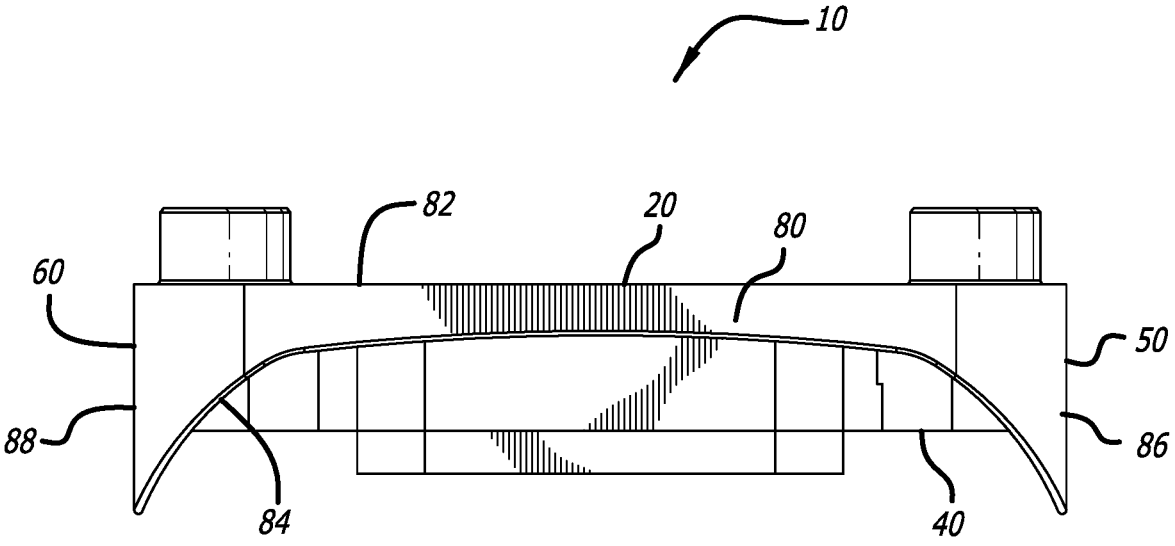
FIG. 8 is a rear plan view of a sight mount disclosed herein.

In one embodiment, a sight mount disclosed herein is rectangular in shape and comprises with a top surface, a bottom surface, a front side, a rear side, a right side and a left side. In an aspect of this embodiment, and referring to FIGS. 1-8, a sight mount 10 can be rectangular in shape with a top surface 20, a bottom surface 40, a right side 50 and a left side 60, a front side 70, and a rear side 80. As further shown best in FIGS. 1, 2 & 4, sight mount 10 includes a front right corner 12, a front left corner 14, a rear right corner 16 and a rear left corner 18, each of which are rounded in shape.

A sight mount disclosed herein can comprise a top surface and a bottom surface, where the top surface and the bottom surface are opposing and spaced apart from one another.

A top surface and a bottom surface of a sight mount disclosed herein comprises a length and a width dimension. In one embodiment, a top surface and a bottom surface of a sight mount disclosed herein a length. A length of a top surface disclosed herein is the distance between a front-side edge and a rear-side edge of the top surface. A length of a bottom surface disclosed herein is the distance between a front-side edge and a bottom-side edge of the bottom surface. A top surface can be any length so long as the length adequately supports an optical sight. A bottom surface can be any length so long as the length adequately supports a top surface of a sight mount disclosed herein and facilitates the creation of a dust-resistant and water-resistant deal when a slight mount disclosed herein is properly secured to the firearm. In one embodiment, a top surface and a bottom surface of a sight mount disclosed herein are equal in length. In aspects of this embodiment, a top surface and a bottom surface of a sight mount disclosed herein each have a length of, e.g., about 25 mm, about 30 mm, about 35 mm, about 40 mm, about 45 mm, or about 50 mm. In other aspects of this embodiment, a top surface and a bottom surface of a sight mount disclosed herein each have a length of, e.g., at least 25 mm, at least 30 mm, at least 35 mm, at least 40 mm, at least 45 mm, or at least 50 mm. In yet other aspects of this embodiment, a top surface and a bottom surface of a sight mount disclosed herein each have a length of, e.g., at most 25 mm, at most 30 mm, at most 35 mm, at most 40 mm, at most 45 mm, or at most 50 mm. In still other aspects of this embodiment, a top surface and a bottom surface of a sight mount disclosed herein each have a length of, e.g., about 25 mm to about 30 mm, about 25 mm to about 35 mm, about 25 mm to about 40 mm, about 25 mm to about 45 mm, about 25 mm to about 50 mm, about 30 mm to about 35 mm, about 30 mm to about 40 mm, about 30 mm to about 45 mm, about 30 mm to about 50 mm, about 35 mm to about 40 mm, about 35 mm to about 45 mm, about 35 mm to about 50 mm, about 40 mm to about 45 mm, about 40 mm to about 50 mm, or about 45 mm to about 50 mm.

In one embodiment, a top surface and a bottom surface of a sight mount disclosed herein a width. A width of a top surface disclosed herein is the distance between a ride-side edge and a left-side edge of the top surface. A width of a bottom surface disclosed herein is the distance between a ride-side edge and a left-side edge of the bottom surface. A top surface can be any width so long as the width adequately supports an optical sight. A bottom surface can be any width so long as the width adequately supports a top surface of a sight mount disclosed herein and facilitates the creation of a dust-resistant and water-resistant deal when a slight mount disclosed herein is properly secured to the firearm.

In one embodiment, a top surface and a bottom surface of a sight mount disclosed herein are equal in width. In aspects of this embodiment, a top surface and a bottom surface of a sight mount disclosed herein each have a width of, e.g., about 15 mm, about 20 mm, about 25 mm, about 30 mm, or about 35 mm. In other aspects of this embodiment, a top surface and a bottom surface of a sight mount disclosed herein each have a width of, e.g., at least 15 mm, at least 20 mm, at least 25 mm, at least 30 mm, or at least 35 mm. In yet other aspects of this embodiment, a top surface and a bottom surface of a sight mount disclosed herein each have a width of, e.g., at most 15 mm, at most 20 mm, at most 25 mm, at most 30 mm, or at most 35 mm. In still other aspects of this embodiment, a top surface and a bottom surface of a sight mount disclosed herein each have a width of, e.g., about 15 mm to about 20 mm, about 15 mm to about 25 mm, about 15 mm to about 30 mm, about 15 mm to about 35 mm, about 20 mm to about 25 mm, about 20 mm to about 30 mm, about 20 mm to about 35 mm, about 25 mm to about 30 mm, about 25 mm to about 35 mm, or about 30 mm to about 35 mm.

A top surface of a sight mount disclosed herein faces outwardly from an area of a firearm where a sight is desired to be attached to the firearm. A top surface of a sight mount disclosed herein is designed to receive a sight in a manner that secures the sight to a firearm. A top surface of a sight mount disclosed herein is substantially flat. In an aspect of this embodiment, a top surface of a sight mount disclosed herein is entirely flat. In another embodiment, a top surface of a sight mount disclosed herein comprises one or more hollow depressions which represent void spaces where excess material was eliminated or removed to reduce the weight of a sight mount disclosed herein. In an aspect of this embodiment, a top surface of a sight mount disclosed herein comprises one or more hollow depressions defined by following the contours of a bottom surface disclosed herein and serve to reduce the overall weight of a sight mount disclosed herein. In an aspect of this embodiment, and referring to FIGS. 1 & 2, top surface 20 comprises weight reducing depressions 21.

A top surface of a sight mount disclosed herein comprises one or more slide mount holes, one or more sight mount holes and optionally one or more mounting pins. In an aspect of this embodiment, a sight mount disclosed herein comprises two slide mount holes, two sight mount holes and two mounting pins. In an aspect of this embodiment, and referring to FIGS. 1 & 2, top surface 20 is shown with two slide mount holes 22 and 24, two sight mount holes 26 and 28 and two mounting pins 30 and 32.

A bottom of a slide mount disclosed herein abuts an area of a firearm where a sight is desired to be attached to the firearm. A bottom of a slide mount disclosed herein is designed to follow the contours of an area of a firearm where a sight mount disclosed herein is to be installed to ensure proper fitting of the slight mount to the firearm and minimize the amount of material needed to make the slight mount in order to reduce the overall weight of the slide mount. In an embodiment, a bottom surface of a sight mount disclosed herein comprises regions that are curvilinear. In another embodiment, a bottom surface of a sight mount disclosed herein comprises one or more hollow depressions which represent void spaces where excess material was eliminated or removed to reduce the weight of a sight mount disclosed herein. In an aspect of this embodiment, a bottom surface of a sight mount disclosed herein comprises one or more hollow depressions defined by following the contours of an area of a firearm where a sight mount disclosed herein is to be installed. In an aspect of this embodiment, and referring to FIGS. 3 & 4, bottom surface 40 comprises weight-reducing depressions 41 and curvilinear regions 48. In another embodiment, a bottom surface is defined by the contours of an area of a FN 5.7 handgun where a sight mount disclosed herein is to be installed, such as, e.g., FN 5.7 Mark I handgun or FN 5.7 Mark II handgun.

A sight mount disclosed herein can comprise a right side and a left side, where the right side and the left side are opposing and spaced apart from one another, such spacing depended on the width of a top surface disclosed herein. A right side and a left side of a slide mount disclosed herein are designed to follow the contours of an area of a firearm where a sight mount disclosed herein is to be installed in order to creates a dust-resistant and water-resistant deal when a slight mount disclosed herein is properly secured to the firearm. A right side and a left side of a slide mount disclosed herein comprise a top edge that is generally linear, a bottom edge that is typically curvilinear, and front- and rear-side edges that are generally curvilinear. In an embodiment, a right side and a left side of a slide mount disclosed herein have bottom edges that are substantially similar in shape. In an aspect of this embodiment, a right side and a left side of a slide mount disclosed herein have bottom edges that are identical in shape. In another aspect of this embodiment, a right side and a left side of a slide mount disclosed herein each have a bottom edge that is curvilinear in shape. In yet another aspect of this embodiment, and referring to FIGS. 5 & 6, right side 50 comprises a linear top edge 52, a curvilinear bottom edge 54, a curvilinear front-side edge 56 and a curvilinear rear-side edge 58, and left side 60 comprises a linear top edge 62, a curvilinear bottom edge 64, a curvilinear front-side edge 66 and a curvilinear rear-side edge 68 where the curvilinear bottom edges are substantially similar in shape to each other.

Certain firearms have asymmetrical differences in the area where a sight is desired to be mounted. As such, in another aspect of this embodiment, a left side and a right side of a slide mount disclosed herein are different in shape to account for an asymmetry in an area of a firearm where a sight mount disclosed herein is to be installed.

A right side and a left side of a sight mount disclosed herein comprises a length and a height dimension. In one embodiment, a right side and a left side of a sight mount disclosed herein a length. A length of a right side disclosed herein is the distance between a front-side edge and a rear-side edge of the right side. A length of a left side disclosed herein is the distance between a front-side edge and a rear-side edge of the left side. A right side and a left side can be a length so long as each length adequately supports a top surface of a sight mount disclosed herein. In one embodiment, right side and a left side of a sight mount disclosed herein are equal in length. In aspects of this embodiment, a right side and a left side of a sight mount disclosed herein each have a length of, e.g., about 25 mm, about 30 mm, about 35 mm, about 40 mm, about 45 mm, or about 50 mm. In other aspects of this embodiment, a right side and a left side of a sight mount disclosed herein each have a length of, e.g., at least 25 mm, at least 30 mm, at least 35 mm, at least 40 mm, at least 45 mm, or at least 50 mm. In yet other aspects of this embodiment, a right side and a left side of a sight mount disclosed herein each have a length of, e.g., at most 25 mm, at most 30 mm, at most 35 mm, at most 40 mm, at most 45 mm, or at most 50 mm. In still other aspects of this embodiment, a right side and a left side of a sight mount disclosed herein each have a length of, e.g., about 25 mm to about 30 mm, about 25 mm to about 35 mm, about 25 mm to about 40 mm, about 25 mm to about 45 mm, about 25 mm to about 50 mm, about 30 mm to about 35 mm, about 30 mm to about 40 mm, about 30 mm to about 45 mm, about 30 mm to about 50 mm, about 35 mm to about 40 mm, about 35 mm to about 45 mm, about 35 mm to about 50 mm, about 40 mm to about 45 mm, about 40 mm to about 50 mm, or about 45 mm to about 50 mm.

In one embodiment, a right side and a left side of a sight mount disclosed herein a height. A height of a right side disclosed herein is the distance between a top edge and a bottom edge of the right side. A height of a left side disclosed herein is the distance between a front edge and a bottom edge of the left side. A right side and a left side can be any height so long as each height adequately supports a top surface of a sight mount disclosed herein. In one embodiment, right side and a left side of a sight mount disclosed herein are equal in height. In aspects of this embodiment, a right side and a left side of a sight mount disclosed herein each have a height of, e.g., about 2 mm, about 2.5 mm, about 3 mm, about 3.5 mm, about 4 mm, about 4.5 mm, about 5 mm, about 5.5 mm, about 6 mm, about 6.5 mm, about 7 mm, about 7.5 mm, about 8 mm, about 8.5 mm, about 9 mm, about 9.5 mm, or about 10 mm. In other aspects of this embodiment, a right side and a left side of a sight mount disclosed herein each have a height of, e.g., at least 2 mm, at least 2.5 mm, at least 3 mm, at least 3.5 mm, at least 4 mm, at least 4.5 mm, at least 5 mm, at least 5.5 mm, at least 6 mm, at least 6.5 mm, at least 7 mm, at least 7.5 mm, at least 8 mm, at least 8.5 mm, at least 9 mm, at least 9.5 mm, or at least 10 mm. In yet other aspects of this embodiment, a right side and a left side of a sight mount disclosed herein each have a height of, e.g., at most 2 mm, at most 2.5 mm, at most 3 mm, at most 3.5 mm, at most 4 mm, at most 4.5 mm, at most 5 mm, at most 5.5 mm, at most 6 mm, at most 6.5 mm, at most 7 mm, at most 7.5 mm, at most 8 mm, at most 8.5 mm, at most 9 mm, at most 9.5 mm, or at most 10 mm. In still other aspects of this embodiment, a right side and a left side of a sight mount disclosed herein each have a height of, e.g., about 2 mm to about 3 mm, about 2 mm to about 4 mm, about 2 mm to about 5 mm, about 2 mm to about 6 mm, about 2 mm to about 7 mm, about 2 mm to about 8 mm, about 2 mm to about 9 mm, about 2 mm to about 10 mm, about 3 mm to about 4 mm, about 3 mm to about 5 mm, about 3 mm to about 6 mm, about 3 mm to about 7 mm, about 3 mm to about 8 mm, about 3 mm to about 9 mm, about 3 mm to about 10 mm, about 4 mm to about 5 mm, about 4 mm to about 6 mm, about 4 mm to about 7 mm, about 4 mm to about 8 mm, about 4 mm to about 9 mm, about 4 mm to about 10 mm, about 5 mm to about 6 mm, about 5 mm to about 7 mm, about 5 mm to about 8 mm, about 5 mm to about 9 mm, about 5 mm to about 10 mm, about 6 mm to about 7 mm, about 6 mm to about 8 mm, about 6 mm to about 9 mm, about 6 mm to about 10 mm, about 7 mm to about 8 mm, about 7 mm to about 9 mm, about 7 mm to about 10 mm, about 8 mm to about 9 mm, about 8 mm to about 10 mm, or about 9 mm to about 10 mm.

In addition, a left side and a right side of a slide mount disclosed herein comprise a bottom edge that is generally linear although in aspects of this embodiment, a bottom edge of a left side and a right side of a slide mount disclosed herein can comprise one or more notches to account for a component of a firearm, e.g., a release pin. In an aspect of this embodiment, and referring to FIGS. 5 & 6, right side 50 comprises a curvilinear bottom edge 54 including notch 55 and left side 60 comprises a curvilinear bottom edge 64 including notch 65.

A sight mount disclosed herein can comprise a front side and a rear side, where the front side and the rear side are opposing and spaced apart from one another. A front side and a rear side of a slide mount disclosed herein are designed to follow the contours of an area of a firearm where a sight mount disclosed herein is to be installed in order to creates a dust-resistant and water-resistant deal when a slight mount disclosed herein is properly secured to the firearm. In one embodiment, a right and a left side follow the contours of an area of a FN 5.7 handgun where a sight mount disclosed herein is to be installed, such as, e.g., FN 5.7 Mark I handgun or FN 5.7 Mark II handgun.

A front side and a rear side of a slide mount disclosed herein comprise an top edge that is generally linear, a bottom edge that is typically curvilinear, and right- and left-side edges that are generally linear. In an embodiment, a front side and a back side of a slide mount disclosed herein have bottom edges that are substantially similar in shape. In an aspect of this embodiment, a front side and a back side of a slide mount disclosed herein have bottom edges that are identical in shape. In another aspect of this embodiment, a front side and a back side of a slide mount disclosed herein each have a bottom edge that is curvilinear in shape. In yet another aspect of this embodiment, and referring to FIG. 7, front side 70 comprises a linear top edge 72 and a curvilinear bottom edge 74, linear right-side edge 76 which abuts curvilinear front-side edge 56 of right side 50 to form a front right corner 12 and linear left-side edge 78 which abuts curvilinear front-side edge 66 of left side 60 to form a front left corner 14. In still another aspect of this embodiment, and referring to FIG. 8, rear side 80 comprises a linear top edge 82, a curvilinear bottom edge 84, a linear right-side edge 86 which abuts curvilinear rear-side edge 58 of right side 50 to form a rear right corner 16 and linear left-side edge 88 which abuts curvilinear rear-side edge 68 of left side 60 to form a rear left corner 18. In another aspect of this embodiment, and referring to FIGS. 7 & 8, curvilinear bottom edge 74 of front side 70 and curvilinear edge 84 of rear side 80 are substantially similar in shape to each other.

Certain firearms have asymmetrical differences in the area where a sight is desired to be mounted. As such, in another aspect of this embodiment, a front side and a back side of a slide mount disclosed herein comprise bottom edges that are different in shape to account for an asymmetry in an area of a firearm where a sight mount disclosed herein is to be installed.

A front side of a rear side of a sight mount disclosed herein comprises a length and a height dimension. In one embodiment, a front side of a rear side of a sight mount disclosed herein has a length. A length of a front side disclosed herein is the distance between a right-side edge and a left-side edge of the front side. A length of a rear side disclosed herein is the distance between a right-side edge and a left-side edge of the rear side. A front side of a rear side can be a length so long as each length adequately supports a top surface of a sight mount disclosed herein. In one embodiment, a right side and a front side of a sight mount disclosed herein are equal in length. In aspects of this embodiment, a front side of a rear side of a sight mount disclosed herein each have a length of, e.g., about 15 mm, about 20 mm, about 25 mm, about 30 mm, or about 35 mm. In other aspects of this embodiment, a front side of a rear side of a sight mount disclosed herein each have a length of, e.g., at least 15 mm, at least 20 mm, at least 25 mm, at least 30 mm, or at least 35 mm. In yet other aspects of this embodiment, a front side of a rear side of a sight mount disclosed herein each have a length of, e.g., at most 15 mm, at most 20 mm, at most 25 mm, at most 30 mm, or at most 35 mm. In still other aspects of this embodiment, a front side of a rear side of a sight mount disclosed herein each have a length of, e.g., about 15 mm to about 20 mm, about 15 mm to about 25 mm, about 15 mm to about 30 mm, about 15 mm to about 35 mm, about 20 mm to about 25 mm, about 20 mm to about 30 mm, about 20 mm to about 35 mm, about 25 mm to about 30 mm, about 25 mm to about 35 mm, or about 30 mm to about 35 mm.

In one embodiment, a front side and a rear side of a sight mount disclosed herein a height. A height of a front side disclosed herein is the distance between a top edge and a bottom edge of the front side. A height of a rear side disclosed herein is the distance between a front edge and a bottom edge of the rear side. A front side and a rear side can be any height so long as each height adequately supports a top surface of a sight mount disclosed herein. In one embodiment, front side and a left side of a sight mount disclosed herein are equal in height. In one embodiment, a front and a rear side follow the contours of an area of a FN 5.7 handgun where a sight mount disclosed herein is to be installed, such as, e.g., FN 5.7 Mark I handgun or FN 5.7 Mark II handgun.

Since a front side and rear side bottom edges follow the contours of an area of a firearm where a sight mount disclosed herein is to be installed, a bottom edge is typically curvilinear. In one embodiment, front side and a left side of a sight mount disclosed herein are equal in height when measured from the same position of a curvilinear shape, such as for example midpoint of a front or a rear side and/or a right-side edge or a left-side edge of a front side or a rear side. In aspects of this embodiment, a front side and a rear side of a sight mount disclosed herein each have a height at its midpoint of, e.g., about 1 mm, about 1.5 mm, about 2 mm, about 2.5 mm, about 3 mm, about 3.5 mm, about 4 mm, about 4.5 mm, or about 5 mm. In other aspects of this embodiment, a front side and a rear side of a sight mount disclosed herein each have a height at its midpoint of, e.g., at least 1 mm, at least 1.5 mm, at least 2 mm, at least 2.5 mm, at least 3 mm, at least 3.5 mm, at least 4 mm, at least 4.5 mm, or at least 5 mm. In yet other aspects of this embodiment, a front side and a rear side of a sight mount disclosed herein each have a height at its midpoint of, e.g., at most 1 mm, at most 1.5 mm, at most 2 mm, at most 2.5 mm, at most 3 mm, at most 3.5 mm, at most 4 mm, at most 4.5 mm, or at most 5 mm. In still other aspects of this embodiment, a front side and a rear side of a sight mount disclosed herein each have a height at its midpoint of, e.g., about 1 mm to about 2 mm, about 1 mm to about 3 mm, about 1 mm to about 4 mm, about 1 mm to about 5 mm, about 2 mm to about 3 mm, about 2 mm to about 4 mm, about 2 mm to about 5 mm, about 3 mm to about 4 mm, about 3 mm to about 5 mm, or about 4 mm to about 5 mm.

In aspects of this embodiment, a front side and a rear side of a sight mount disclosed herein each have a height at its right-side and/or its left-side of, e.g., about 2 mm, about 2.5 mm, about 3 mm, about 3.5 mm, about 4 mm, about 4.5 mm, about 5 mm, about 5.5 mm, about 6 mm, about 6.5 mm, about 7 mm, about 7.5 mm, about 8 mm, about 8.5 mm, about 9 mm, about 9.5 mm, or about 10 mm. In other aspects of this embodiment, a front side and a rear side of a sight mount disclosed herein each have a height at its right-side and/or its left-side of, e.g., at least 2 mm, at least 2.5 mm, at least 3 mm, at least 3.5 mm, at least 4 mm, at least 4.5 mm, at least 5 mm, at least 5.5 mm, at least 6 mm, at least 6.5 mm, at least 7 mm, at least 7.5 mm, at least 8 mm, at least 8.5 mm, at least 9 mm, at least 9.5 mm, or at least 10 mm. In yet other aspects of this embodiment, a front side and a rear side of a sight mount disclosed herein each have a height at its right-side and/or its left-side of, e.g., at most 2 mm, at most 2.5 mm, at most 3 mm, at most 3.5 mm, at most 4 mm, at most 4.5 mm, at most 5 mm, at most 5.5 mm, at most 6 mm, at most 6.5 mm, at most 7 mm, at most 7.5 mm, at most 8 mm, at most 8.5 mm, at most 9 mm, at most 9.5 mm, or at most 10 mm. In still other aspects of this embodiment, a front side and a rear side of a sight mount disclosed herein each have a height at its right-side and/or its left-side of, e.g., about 2 mm to about 3 mm, about 2 mm to about 4 mm, about 2 mm to about 5 mm, about 2 mm to about 6 mm, about 2 mm to about 7 mm, about 2 mm to about 8 mm, about 2 mm to about 9 mm, about 2 mm to about 10 mm, about 3 mm to about 4 mm, about 3 mm to about 5 mm, about 3 mm to about 6 mm, about 3 mm to about 7 mm, about 3 mm to about 8 mm, about 3 mm to about 9 mm, about 3 mm to about 10 mm, about 4 mm to about 5 mm, about 4 mm to about 6 mm, about 4 mm to about 7 mm, about 4 mm to about 8 mm, about 4 mm to about 9 mm, about 4 mm to about 10 mm, about 5 mm to about 6 mm, about 5 mm to about 7 mm, about 5 mm to about 8 mm, about 5 mm to about 9 mm, about 5 mm to about 10 mm, about 6 mm to about 7 mm, about 6 mm to about 8 mm, about 6 mm to about 9 mm, about 6 mm to about 10 mm, about 7 mm to about 8 mm, about 7 mm to about 9 mm, about 7 mm to about 10 mm, about 8 mm to about 9 mm, about 8 mm to about 10 mm, or about 9 mm to about 10 mm.

Figure 2:
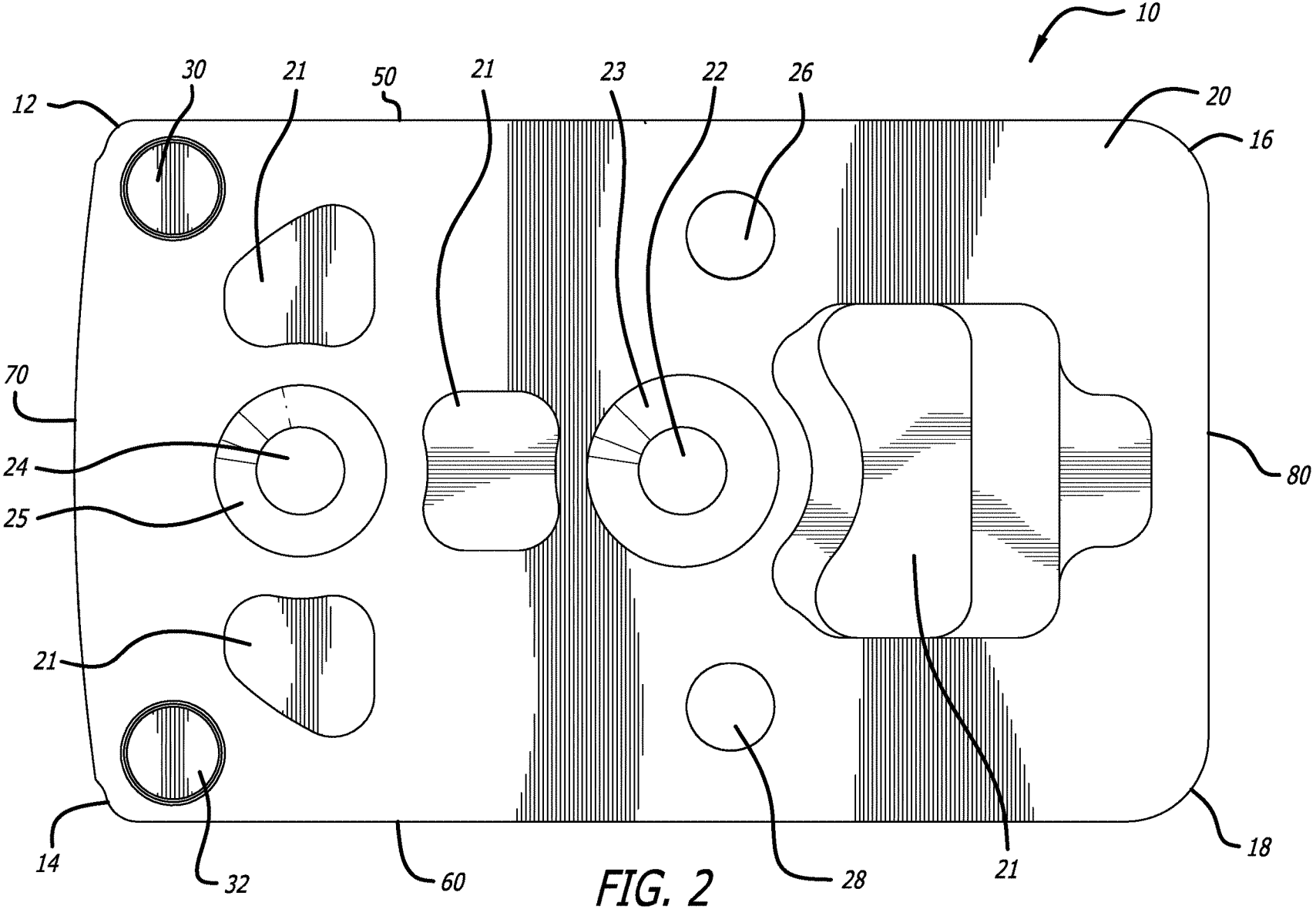
FIG. 2 is a top plan view of a sight mount disclosed herein.
Figure 3:
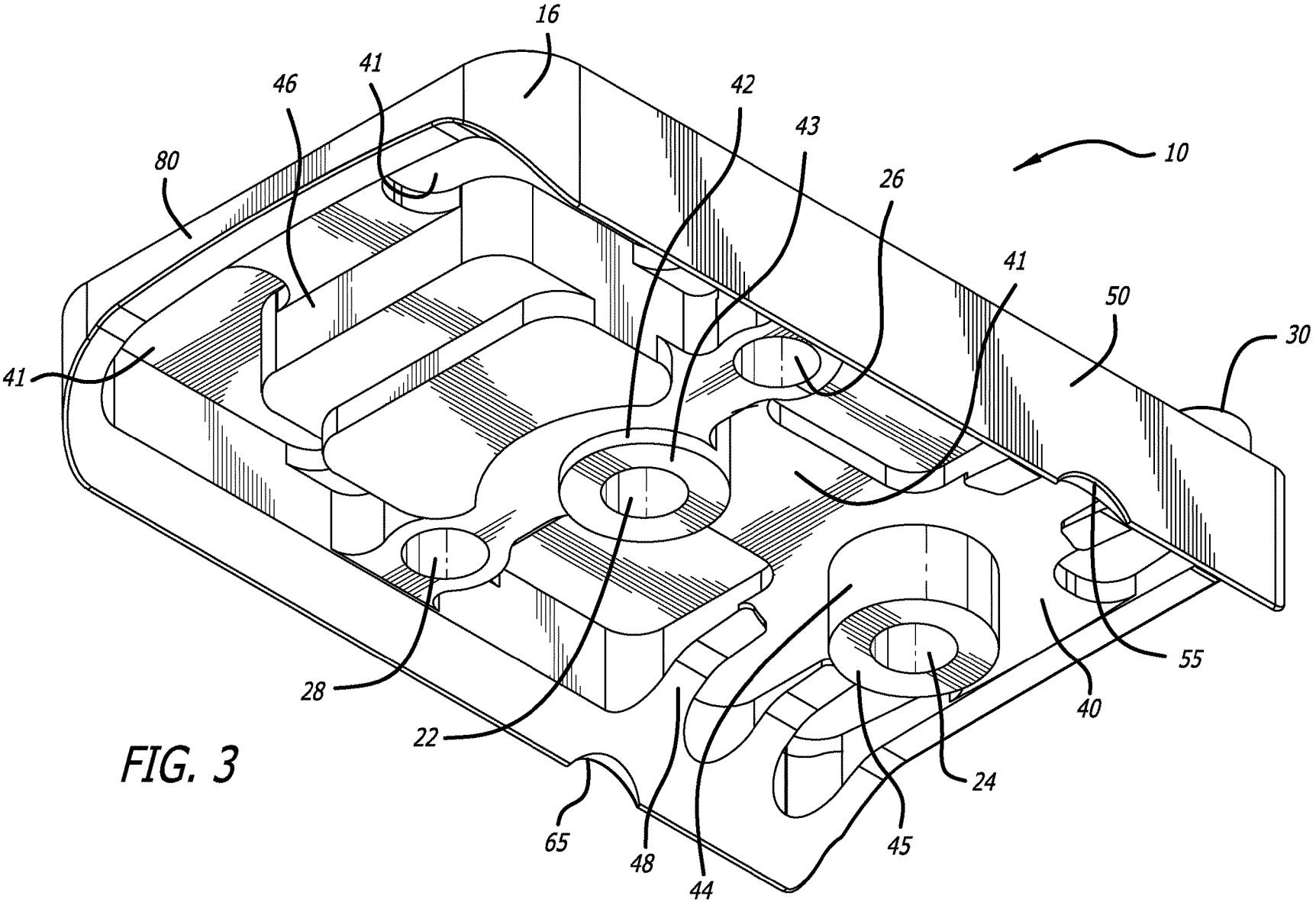
FIG. 3 is a bottom rear perspective view of a sight mount disclosed herein.
Figure 20:
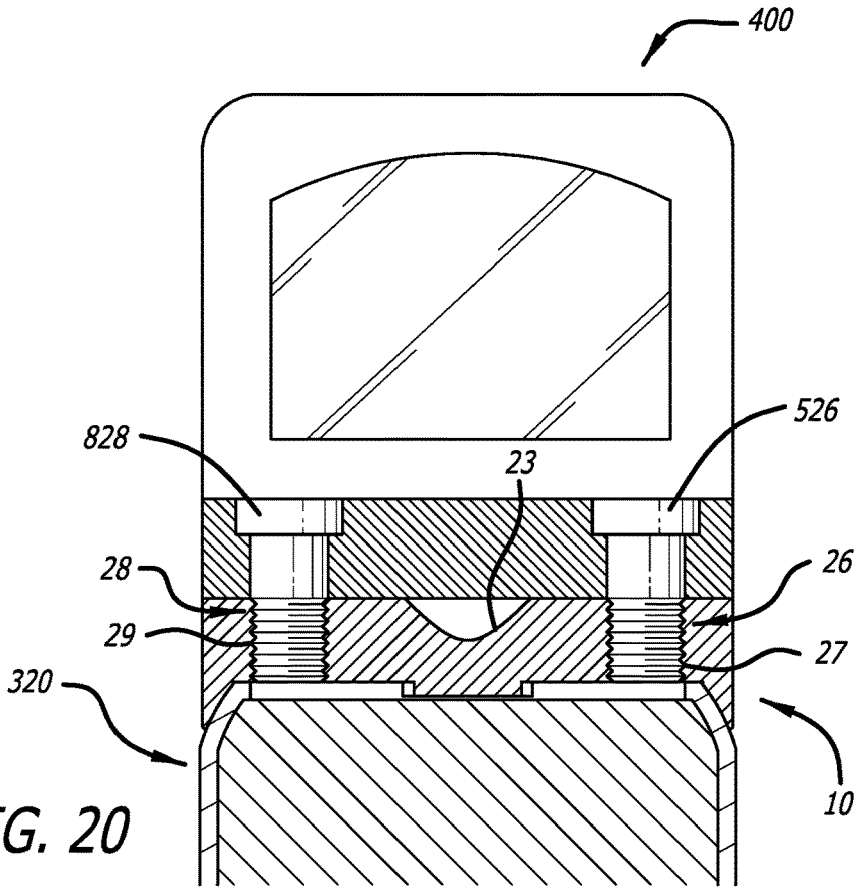
FIG. 20 is rear cross-sectional view of a firearm modified according to a method disclosed herein and comprising a sight mount disclosed herein and an optical slight.
Figure 21:
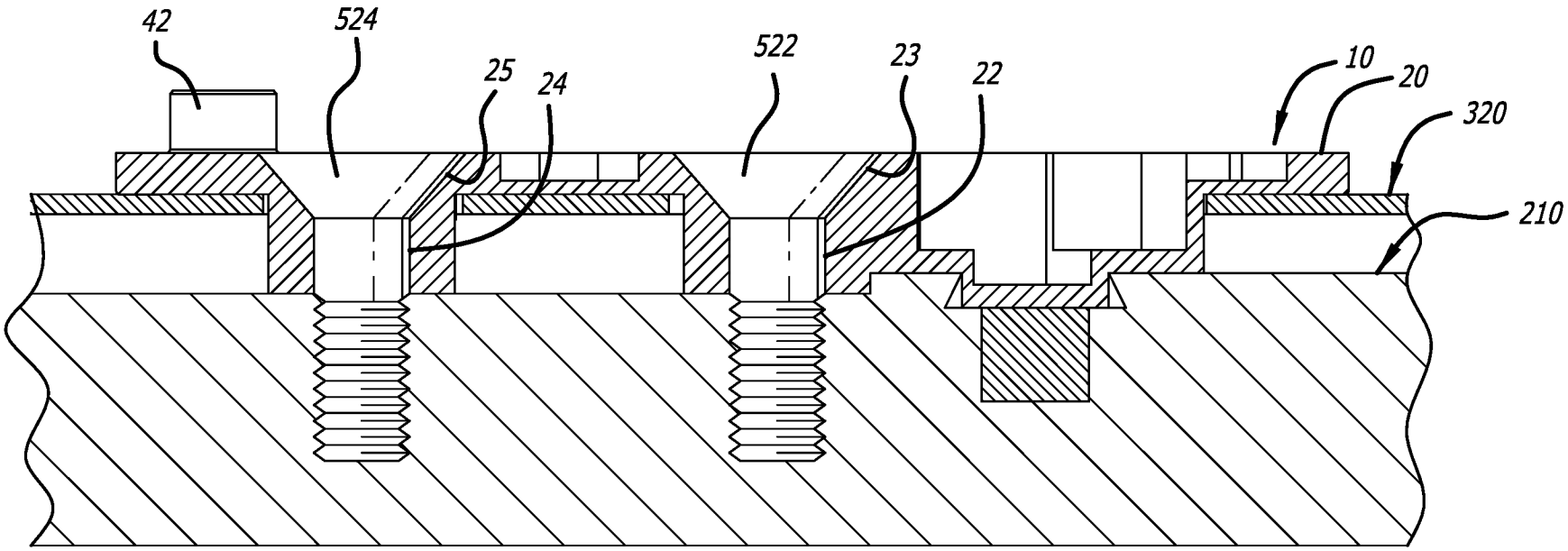
FIG. 21 is left-side cross-sectional view of a firearm modified according to a method disclosed herein and comprising a sight mount disclosed herein and an optical slight.

A slide mount hole disclosed herein is designed to receive threaded screws used to attach a slide mount disclosed herein to a firearm. In one embodiment, an area surrounding a slide mount hole disclosed herein is countersunk to create a conical depression. For example, as shown in FIGS. 1, 2 & 20, slide mount hole 22 comprises countersunk region 23 and slide mount hole 24 comprises countersunk region 25. A countersunk region ensures that a top of a threaded screw used to secure a sight mount disclosed herein to a firearm is flush with a top surface of a sight mount disclosed herein in order to achieve proper attachment of a sight to the sight mount. In addition, countersinking the screw head enable more of the screw length to be above the slide mount screw hole, which increase the attachment strength of a slight mount disclosed herein to a firearm. For example, as best show in FIG. 20 slide mount holes 22 and 24 comprise countersunk regions 23 and 25 in a manner where the top of threaded screws 522 and 524 are flush with top surface 20 of sight mount 10.

Figure 9A:
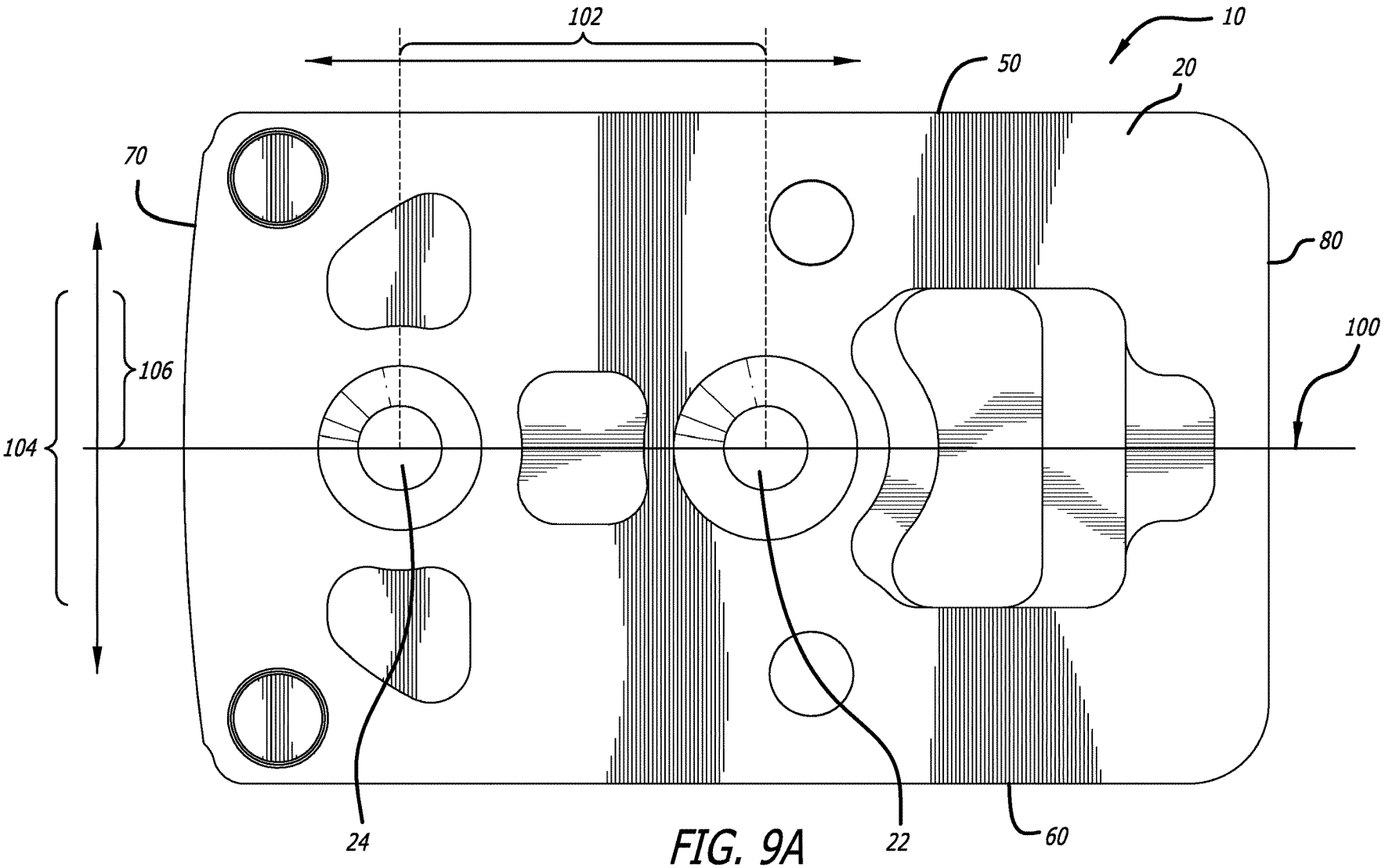
FIG. 9A is a top plan view of a sight mount disclosed herein depicting central y-axis, slide mount hole separation distance, slide mount hole offset distance, central y-axis distance.

The location of slide mount holes from each other is defined by a slide mount hole separation distance and a slide mount hole offset distance. A slide mount hole separation distance is the distance from one slide mount hole to the other slide mount hole measured from the center of each hole and in a direction running parallel to a central y-axis of a sight mount disclosed herein. As shown in FIG. 9A, central y-axis 100 bisects sight mount 10 and runs in the direction parallel to the right 50 and left 60 sides of slight mount 10. The location of slide mount holes can be of any reasonable distance so long as the slide mount hole separation distance is sufficient to properly secure a sight mount disclosed herein to a firearm and the slide mount hole separation distance does not impede the operation or structural integrity of a sight mount disclosed herein.

In aspects of this embodiment, a slide mount hole separation distance between two slide mount holes is, e.g., about 11 mm, about 12 mm, about 13 mm, about 14, mm, about 15 mm, about 16 mm, about 17 mm, about 18 mm, about 19 mm, or about 20 mm. In other aspects of this embodiment, a slide mount hole separation distance between two slide mount holes is, e.g., at least 11 mm, at least 12 mm, at least 13 mm, at least 14, mm, at least 15 mm, at least 16 mm, at least 17 mm, at least 18 mm, at least 19 mm, or at least 20 mm. In yet other aspects of this embodiment, a slide mount hole separation distance between two slide mount holes is, e.g., at most 11 mm, at most 12 mm, at most 13 mm, at most 14, mm, at most 15 mm, at most 16 mm, at most 17 mm, at most 18 mm, at most 19 mm, or at most 20 mm. In yet other aspects of this embodiment, a slide mount hole separation distance between two slide mount holes is, e.g., about 11 mm to about 12 mm, about 11 mm to about 13 mm, about 11 mm to about 14 mm, about 11 mm to about 15 mm, about 11 mm to about 16 mm, about 11 mm to about 17 mm, about 11 mm to about 18 mm, about 11 mm to about 19 mm, about 11 mm to about 20 mm, about 12 mm to about 13 mm, about 12 mm to about 14 mm, about 12 mm to about 15 mm, about 12 mm to about 16 mm, about 12 mm to about 17 mm, about 12 mm to about 18 mm, about 12 mm to about 19 mm, about 12 mm to about 20 mm, about 13 mm to about 14 mm, about 13 mm to about 15 mm, about 13 mm to about 16 mm, about 13 mm to about 17 mm, about 13 mm to about 18 mm, about 13 mm to about 19 mm, about 13 mm to about 20 mm, about 14 mm to about 15 mm, about 14 mm to about 16 mm, about 14 mm to about 17 mm, about 14 mm to about 18 mm, about 14 mm to about 19 mm, about 14 mm to about 20 mm, about 15 mm to about 16 mm, about 15 mm to about 17 mm, about 15 mm to about 18 mm, about 15 mm to about 19 mm, about 15 mm to about 20 mm, about 16 mm to about 17 mm, about 16 mm to about 18 mm, about 16 mm to about 19 mm, about 16 mm to about 20 mm, about 17 mm to about 18 mm, about 17 mm to about 19 mm, about 17 mm to about 20 mm, about 18 mm to about 19 mm, about 18 mm to about 20 mm, or about 19 mm to about 20 mm.

In aspects of this embodiment, a slide mount hole separation distance between two slide mount holes is, e.g., about 3 mm, about 4 mm, about 5 mm, about 6 mm, about 7 mm, about 8 mm, about 9 mm or about 10 mm. In other aspects of this embodiment, a slide mount hole separation distance between two slide mount holes is, e.g., at least 3 mm, at least 4 mm, at least 5 mm, at least 6 mm, at least 7 mm, at least 8 mm, at least 9 mm or at least 10 mm. In yet other aspects of this embodiment, a slide mount hole separation distance between two slide mount holes is, e.g., at most 3 mm, at most 4 mm, at most 5 mm, at most 6 mm, at most 7 mm, at most 8 mm, at most 9 mm or at most 10 mm. In still other aspects of this embodiment, a slide mount hole separation distance between two slide mount holes is, e.g., about 3 mm to about 4 mm, about 3 mm to about 5 mm, about 3 mm to about 6 mm, about 3 mm to about 7 mm, about 3 mm to about 8 mm, about 3 mm to 9 mm, about 3 mm to about 10 mm, about 4 mm to about 5 mm, about 4 mm to about 6 mm, about 4 mm to about 7 mm, about 4 mm to about 8 mm, about 4 mm to 9 mm, about 4 mm to about 10 mm, about 5 mm to about 7 mm, about 5 mm to about 8 mm, about 5 mm to 9 mm, about 5 mm to about 10 mm, about 6 mm to about 7 mm, about 6 mm to about 8 mm, about 6 mm to 9 mm, about 6 mm to about 10 mm, about 7 mm to about 8 mm, about 7 mm to 9 mm, about 7 mm to about 10 mm, about 8 mm to 9 mm, about 8 mm to about 10 mm, or about 9 mm to about 10 mm.

In one embodiment, slide mount holes are located parallel to each other along a central y-axis of a slide. In an aspect of this embodiment, and referring to FIG. 2, slide mount holes 22 and 24 are located parallel to each other along central y-axis 100 of sight mount 10. In another embodiment, and referring to FIG. 9A, slide mount hole separation distance 102 between slide mount hole 22 and slide mount hole 24 is about 6 mm.

A slide mount hole offset distance is the distance from one slide mount hole to the other slide mount hole measured in a direction perpendicular to a central y-axis of a sight mount disclosed herein. For example, as shown in FIG. 9A, slide mount offset distance 104 is depicted. The location of slide mount holes can be of any distance so long as the slide mount hole offset distance is sufficient to properly secure a sight mount disclosed herein to a firearm and the slide mount hole offset distance does not impede the operation or structural integrity of a sight mount disclosed herein.

In one embodiment, the slide mount holes have a slide mount hole offset distance of zero. In an aspect of this embodiment, the slide mount holes have a slide mount hole offset distance of zero and are aligned on the central y-axis of a sight mount disclosed herein. In another aspect of this embodiment, the slide mount holes have a slide mount hole offset distance of zero and are aligned on the central y-axis of a sight mount disclosed herein with one slide mount hole located on one side of the take down hole of a firearm and the other slide mount hole located on the opposite side of the take down hole of a firearm. As shown in FIG. 9A, an exemplary slide mount hole offset distance 104 between slide mount hole 22 and slide mount hole 24 is zero.

In one embodiment, the slide mount holes have a slide mount hole offset distance of greater than zero. In an aspect of this embodiment, the slide mount holes have a slide mount hole offset distance of greater than zero and are aligned on the central y-axis of a sight mount disclosed herein. In another aspect of this embodiment, the slide mount holes have a slide mount hole offset distance of greater than zero and are aligned on the central y-axis of a sight mount disclosed herein with the locations of the slide mount holes positioned so that when attached to a firearm one slide mount hole is located on one side of the take down hole of a firearm and the other slide mount hole located on the opposite side of the take down hole of the firearm.

In one embodiment, the slide mount holes have a slide mount hole offset distance of greater than zero, with a central y-axis distance of each slide mount hole being equal to the other slide mount hole. A central y-axis distance is the distance of a slide mount hole from the central y-axis of the slide in a perpendicular direction. For example, as shown in FIG. 9A, central y-axis distance 106 is depicted. In aspects of this embodiment, the slide mount holes have a slide mount hole offset distance of greater than zero, with a central y-axis distance of each slide mount hole being equal to the other slide mount hole. For example, when slide mount hole 22 and slide mount hole 24 have a slide mount hole offset distance 104 of 2 mm with each of slide mount holes 22 and 24 being 1 mm from central y-axis 100, indicating that central y-axis distance 106 for each slide mount hole is equal to one another, i.e., 1 mm. In one embodiment, and referring to FIG. 9A, slide mount hole 22 and slide mount hole 24 have a slide mount hole offset distance 104 of 0 mm with each of slide mount holes 22 and 24 being 3 mm from central y-axis 100, indicating that central y-axis distance 106 for each slide mount hole is equal to one another, i.e., 0 mm.

In one embodiment, the slide mount holes have a slide mount hole offset distance of greater than zero, with a central y-axis distance of each slide mount hole being different from the other slide mount hole. In an aspect of this embodiment, the slide mount holes have a slide mount hole offset distance of greater than zero, with a central y-axis distance of each slide mount hole being different from other slide mount hole with one slide mount hole located on one side of the take down hole of a firearm and the other slide mount hole located on the opposite side of the take down hole of a firearm.

In other aspects of this embodiment, one slide mount hole is located from the other slide mount hole by a slide mount hole offset distance of, e.g., about 0.25 mm, about 0.5 mm, about 0.75 mm, about 1 mm, about 1.25 mm, about 1.5 mm, about 1.75 mm, about 2 mm, about 2.25 mm, about 2.5 mm, about 2.75 mm, or about 3 mm. In other aspects of this embodiment, one slide mount hole is located from the other slide mount hole by a slide mount hole offset distance of, e.g., at least 0.25 mm, at least 0.5 mm, at least 0.75 mm, at least 1 mm, at least 1.25 mm, at least 1.5 mm, at least 1.75 mm, at least 2 mm, at least 2.25 mm, at least 2.5 mm, at least 2.75 mm, or at least 3 mm. In yet other aspects of this embodiment, one slide mount hole is located from the other slide mount hole by a slide mount hole offset distance of, e.g., at most 0.25 mm, at most 0.5 mm, at most 0.75 mm, at most 1 mm, at most 1.25 mm, at most 1.5 mm, at most 1.75 mm, at most 2 mm, at most 2.25 mm, at most 2.5 mm, at most 2.75 mm, or at most 3 mm. In still other aspects of this embodiment, one slide mount hole is located from the other slide mount hole by a slide mount hole offset distance of, e.g., about 0.0 mm to about 0.5 mm, about 0.0 mm to about 0.75 mm, about 0.0 mm to about 1 mm, about 0.0 mm to about 1.25 mm, 0.0 mm to about 1.5 mm, about 0.0 mm to about 1.75 mm, about 0.0 mm to about 2 mm, about 0.0 mm to about 2.25 mm, 0.0 mm to about 2.5 mm, about 0.0 mm to about 2.75 mm, or about 0.0 mm to about 3 mm, about 0.25 mm to about 0.5 mm, about 0.25 mm to about 0.75 mm, about 0.25 mm to about 1 mm, about 0.25 mm to about 1.25 mm, 0.25 mm to about 1.5 mm, about 0.25 mm to about 1.75 mm, about 0.25 mm to about 2 mm, about 0.25 mm to about 2.25 mm, 0.25 mm to about 2.5 mm, about 0.25 mm to about 2.75 mm, or about 0.25 mm to about 3 mm, about 0.5 mm to about 0.75 mm, about 0.5 mm to about 1 mm, about 0.5 mm to about 1.25 mm, 0.5 mm to about 1.5 mm, about 0.5 mm to about 1.75 mm, about 0.5 mm to about 2 mm, about 0.5 mm to about 2.25 mm, 0.5 mm to about 2.5 mm, about 0.5 mm to about 2.75 mm, or about 0.5 mm to about 3 mm, about 0.75 mm to about 1 mm, about 0.75 mm to about 1.25 mm, 0.75 mm to about 1.5 mm, about 0.75 mm to about 1.75 mm, about 0.75 mm to about 2 mm, about 0.75 mm to about 2.25 mm, 0.75 mm to about 2.5 mm, about 0.75 mm to about 2.75 mm, or about 0.75 mm to about 3 mm, about 1 mm to about 1.25 mm, 1 mm to about 1.5 mm, about 1 mm to about 1.75 mm, about 1 mm to about 2 mm, about 1 mm to about 2.25 mm, 1 mm to about 2.5 mm, about 1 mm to about 2.75 mm, or about 1 mm to about 3 mm, about 1.5 mm to about 2 mm, about 1.5 mm to about 2.5 mm, about 1.5 mm to about 3 mm, about 2 mm to about 2.5 mm, about 2 mm to about 3 mm, or about 2.5 mm to about 3 mm.

In other aspects of this embodiment, a slide mount hole has a central y-axis distance of, e.g., about 0.25 mm, about 0.5 mm, about 0.75 mm, about 1 mm, about 1.25 mm, about 1.5 mm, about 1.75 mm, or about 2 mm. In other aspects of this embodiment, a slide mount hole has a central y-axis distance of, e.g., at least 0.25 mm, at least 0.5 mm, at least 0.75 mm, at least 1 mm, at least 1.25 mm, at least 1.5 mm, at least 1.75 mm, or at least 2 mm. In yet other aspects of this embodiment, a slide mount hole has a central y-axis distance of, e.g., at most 0.25 mm, at most 0.5 mm, at most 0.75 mm, at most 1 mm, at most 1.25 mm, at most 1.5 mm, at most 1.75 mm, or at most 2 mm. In still other aspects of this embodiment, a slide mount hole has a central y-axis distance of, e.g., about 0.0 mm to about 0.5 mm, about 0.0 mm to about 0.75 mm, about 0.0 mm to about 1 mm, about 0.0 mm to about 1.25 mm, 0.0 mm to about 1.5 mm, about 0.0 mm to about 1.75 mm, about 0.0 mm to about 2 mm, about 0.25 mm to about 0.5 mm, about 0.25 mm to about 0.75 mm, about 0.25 mm to about 1 mm, about 0.25 mm to about 1.25 mm, 0.25 mm to about 1.5 mm, about 0.25 mm to about 1.75 mm, about 0.25 mm to about 2 mm, about 0.5 mm to about 0.75 mm, about 0.5 mm to about 1 mm, about 0.5 mm to about 1.25 mm, 0.5 mm to about 1.5 mm, about 0.5 mm to about 1.75 mm, about 0.5 mm to about 2 mm, about 0.75 mm to about 1 mm, about 0.75 mm to about 1.25 mm, 0.75 mm to about 1.5 mm, about 0.75 mm to about 1.75 mm, about 0.75 mm to about 2 mm, about 1 mm to about 1.25 mm, 1 mm to about 1.5 mm, about 1 mm to about 1.75 mm, about 1 mm to about 2 mm, or about 1.5 mm to about 2 mm.

Figure 19:
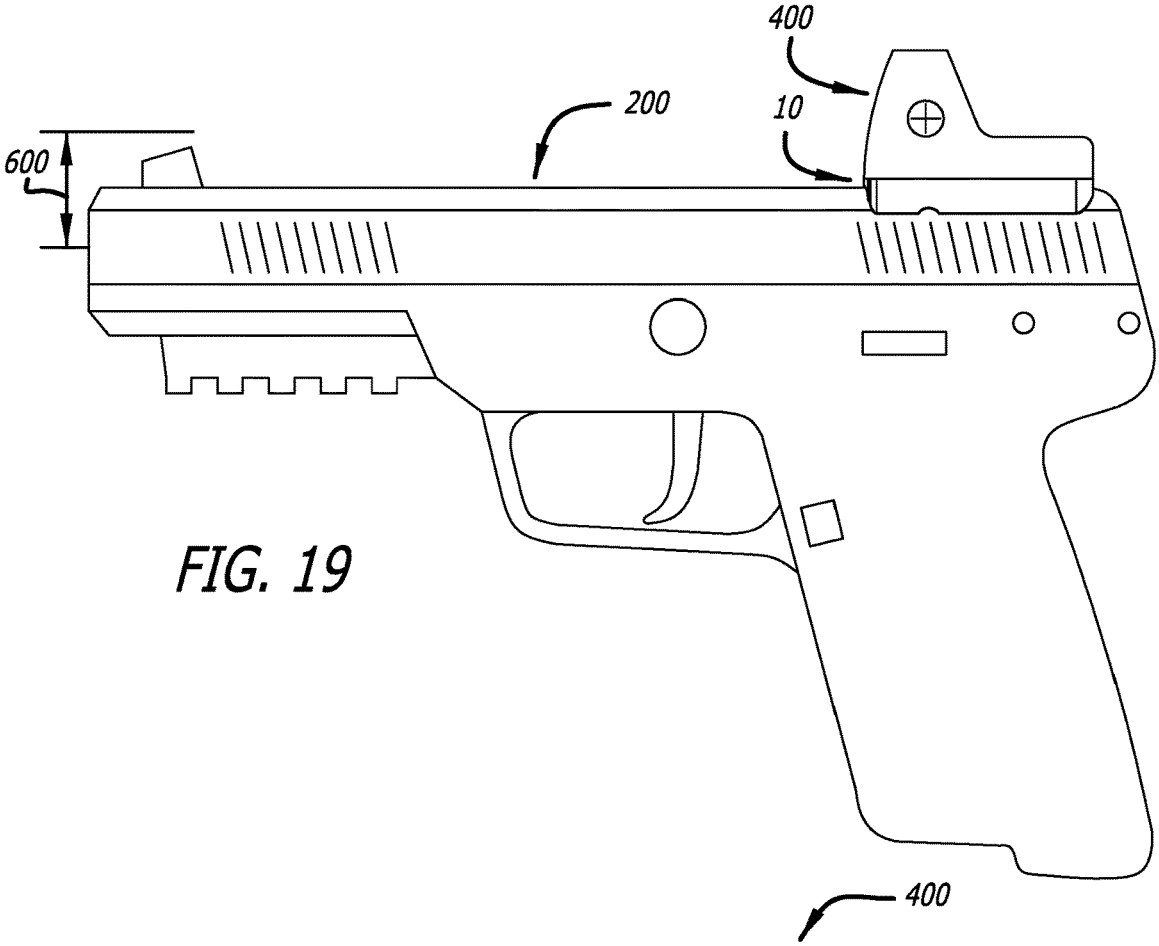
FIG. 19 is left-side plan view of a firearm modified according to a method disclosed herein and comprising a sight mount disclosed herein and an optical slight.

A sight mount hole disclosed herein is designed to receive threaded screws used to attach a sight to a sight mount disclosed herein. In one embodiment, a sight mount hole is threaded. In an aspect of this embodiment, and as best seen in FIG. 19, sight mount hole 26 comprises a threaded region 27 to receive threaded screw 526 and slide mount hole 28 comprises a threaded region 29 to receive threaded screw 528.

The location of sight mount holes from each other is defined by a sight mount hole separation distance and a sight mount hole offset distance. A sight mount hole separation distance is the distance from one sight mount hole to the other sight mount hole measured in a direction running perpendicular to the central y-axis of a sight mount disclosed herein. The location of the sight mount holes can be of any reasonable distance so long as the sight mount hole separation distance is sufficient to properly secure a sight mount disclosed herein to a firearm and the sight mount hole separation distance does not impede the operation or structural integrity of a sight mount disclosed herein.

In aspects of this embodiment, a sight mount hole separation distance between two sight mount holes is, e.g., about 11 mm, about 12 mm, about 13 mm, about 14, mm, about 15 mm, about 16 mm, about 17 mm, about 18 mm, about 19 mm, or about 20 mm. In other aspects of this embodiment, a sight mount hole separation distance between two sight mount holes is, e.g., at least 11 mm, at least 12 mm, at least 13 mm, at least 14, mm, at least 15 mm, at least 16 mm, at least 17 mm, at least 18 mm, at least 19 mm, or at least 20 mm. In yet other aspects of this embodiment, a sight mount hole separation distance between two sight mount holes is, e.g., at most 11 mm, at most 12 mm, at most 13 mm, at most 14, mm, at most 15 mm, at most 16 mm, at most 17 mm, at most 18 mm, at most 19 mm, or at most 20 mm. In yet other aspects of this embodiment, a sight mount hole separation distance between two sight mount holes is, e.g., about 11 mm to about 12 mm, about 11 mm to about 13 mm, about 11 mm to about 14 mm, about 11 mm to about 15 mm, about 11 mm to about 16 mm, about 11 mm to about 17 mm, about 11 mm to about 18 mm, about 11 mm to about 19 mm, about 11 mm to about 20 mm, about 12 mm to about 13 mm, about 12 mm to about 14 mm, about 12 mm to about 15 mm, about 12 mm to about 16 mm, about 12 mm to about 17 mm, about 12 mm to about 18 mm, about 12 mm to about 19 mm, about 12 mm to about 20 mm, about 13 mm to about 14 mm, about 13 mm to about 15 mm, about 13 mm to about 16 mm, about 13 mm to about 17 mm, about 13 mm to about 18 mm, about 13 mm to about 19 mm, about 13 mm to about 20 mm, about 14 mm to about 15 mm, about 14 mm to about 16 mm, about 14 mm to about 17 mm, about 14 mm to about 18 mm, about 14 mm to about 19 mm, about 14 mm to about 20 mm, about 15 mm to about 16 mm, about 15 mm to about 17 mm, about 15 mm to about 18 mm, about 15 mm to about 19 mm, about 15 mm to about 20 mm, about 16 mm to about 17 mm, about 16 mm to about 18 mm, about 16 mm to about 19 mm, about 16 mm to about 20 mm, about 17 mm to about 18 mm, about 17 mm to about 19 mm, about 17 mm to about 20 mm, about 18 mm to about 19 mm, about 18 mm to about 20 mm, or about 19 mm to about 20 mm.

In aspects of this embodiment, a sight mount hole separation distance between two sight mount holes is, e.g., about 3 mm, about 4 mm, about 5 mm, about 6 mm, about 7 mm, about 8 mm, about 9 mm or about 10 mm. In other aspects of this embodiment, a sight mount hole separation distance between two sight mount holes is, e.g., at least 3 mm, at least 4 mm, at least 5 mm, at least 6 mm, at least 7 mm, at least 8 mm, at least 9 mm or at least 10 mm. In yet other aspects of this embodiment, a sight mount hole separation distance between two sight mount holes is, e.g., at most 3 mm, at most 4 mm, at most 5 mm, at most 6 mm, at most 7 mm, at most 8 mm, at most 9 mm or at most 10 mm. In still other aspects of this embodiment, a sight mount hole separation distance between two sight mount holes is, e.g., about 3 mm to about 4 mm, about 3 mm to about 5 mm, about 3 mm to about 6 mm, about 3 mm to about 7 mm, about 3 mm to about 8 mm, about 3 mm to 9 mm, about 3 mm to about 10 mm, about 4 mm to about 5 mm, about 4 mm to about 6 mm, about 4 mm to about 7 mm, about 4 mm to about 8 mm, about 4 mm to 9 mm, about 4 mm to about 10 mm, about 5 mm to about 7 mm, about 5 mm to about 8 mm, about 5 mm to 9 mm, about 5 mm to about 10 mm, about 6 mm to about 7 mm, about 6 mm to about 8 mm, about 6 mm to 9 mm, about 6 mm to about 10 mm, about 7 mm to about 8 mm, about 7 mm to 9 mm, about 7 mm to about 10 mm, about 8 mm to 9 mm, about 8 mm to about 10 mm, or about 9 mm to about 10 mm. In another aspect of this embodiment, and referring to FIG. 9B, an exemplary sight mount hole separation distance 112 between sight mount hole 26 and sight mount hole 28 is about 6 mm.

Figure 9B:
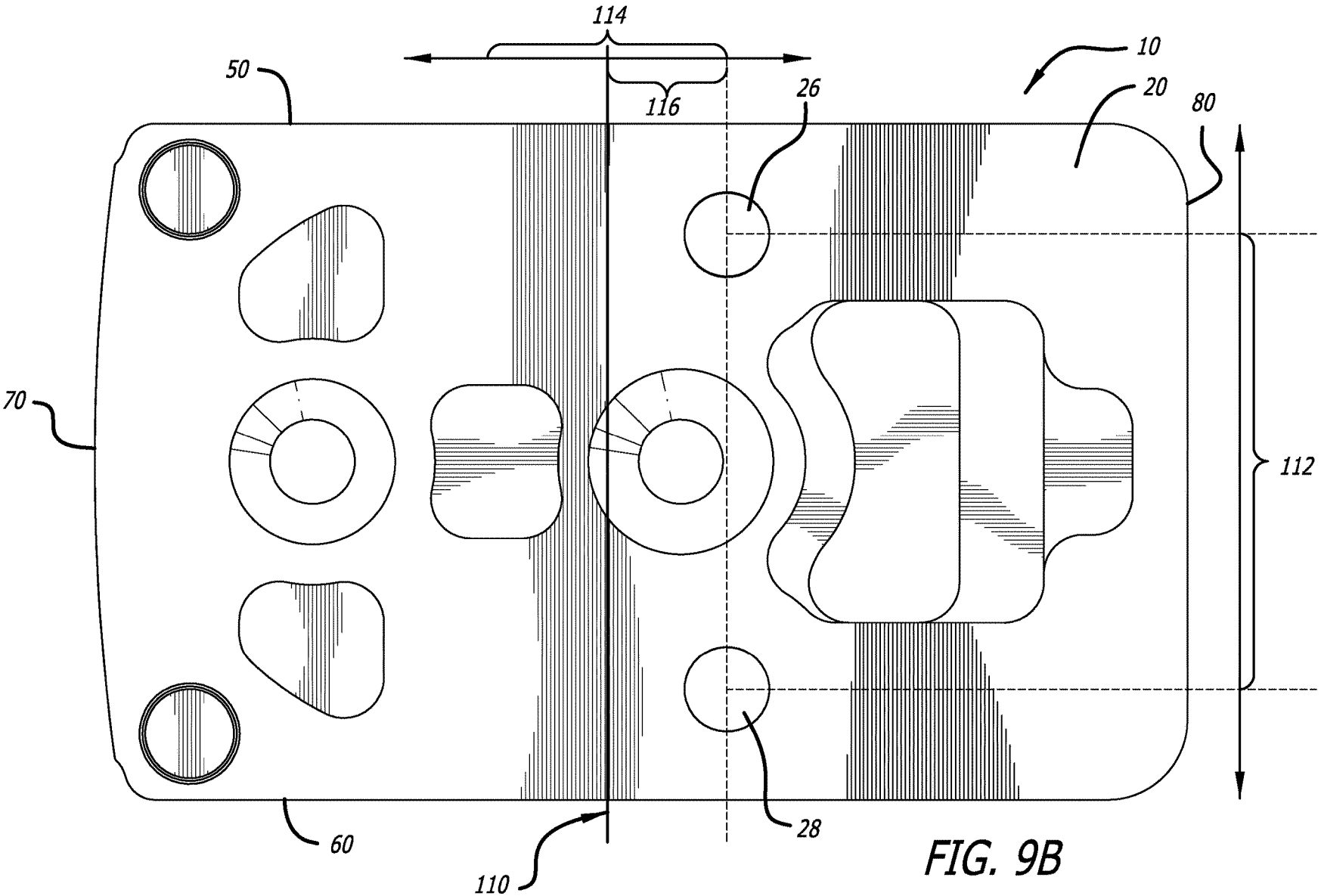
FIG. 9B is a top plan view of a sight mount disclosed herein depicting central x-axis, sight mount hole separation distance, sight mount hole offset distance and central x-axis distance.

A sight mount hole offset distance is the distance from one sight mount hole to the other sight mount hole measured in a direction parallel to the central y-axis of a sight mount disclosed herein. For example, as shown in FIG. 9B, sight mount offset distance 114 is depicted. The location of the sight mount holes can be of any distance so long as the sight mount hole offset distance is sufficient to properly secure a sight mount disclosed herein to a firearm and the sight mount hole offset distance does not impede the operation or structural integrity of a sight mount disclosed herein.

In one embodiment, the sight mount holes have a sight mount hole offset distance of zero. In an aspect of this embodiment, sight mount holes have a sight mount hole offset distance of zero and are aligned on the central x-axis of a slight mount disclosed herein. As shown in FIG. 9B, central x-axis 110 bisects sight mount 10 and runs in the direction perpendicular to the right 50 and left 60 sides of slight mount 10. In an embodiment, a sight mount hole offset distance 114 between two sight mount holes is zero. In another embodiment, and referring to FIG. 9B, an exemplary sight mount hole offset distance 114 between sight mount hole 26 and sight mount hole 28 is about 1 mm rearward from central x-axis 110 (i.e., toward rear side 80 of sight mount 10.

In one embodiment, the sight mount holes have a sight mount hole offset distance of greater than zero. In an aspect of this embodiment, the sight mount holes have a sight mount hole offset distance of greater than zero and are aligned together on the central x-axis of a sight mount disclosed herein.

In one embodiment, the sight mount holes have a sight mount hole offset distance of greater than zero, with a central x-axis distance of each sight mount hole being equal to the other sight mount hole. A central x-axis distance is the distance of a sight mount hole from the central y-axis of a sight mount disclosed herein in a perpendicular direction. For example, as shown in FIG. 9B, central x-axis distance 116 is depicted. In aspects of this embodiment, the sight mount holes have a sight mount hole offset distance of greater than zero, with a central x-axis distance of each sight mount hole being equal to the other sight mount hole. As shown in FIG. 9B, both sight mount hole 26 and sight mount hole 28 have a sight mount hole offset distance 114 of 1 mm rearward from central x-axis 110, indicating that central x-axis distance 116 for each slide mount hole is equal to one another, i.e., 1 mm.

In one embodiment, the sight mount holes have a sight mount hole offset distance of greater than zero, with a central x-axis distance of each sight mount hole being different from the other sight mount hole. In an aspect of this embodiment, the slide mount holes have a sight mount hole offset distance of greater than zero, with a central x-axis distance of each sight mount hole being different from other sight mount hole with one sight mount hole located on one side of the take down hole of a firearm and the other sight mount hole located on the opposite side of the take down hole of a firearm.

In other aspects of this embodiment, one sight mount hole is located from the other sight mount hole by a sight mount hole offset distance of, e.g., about 0.25 mm, about 0.5 mm, about 0.75 mm, about 1 mm, about 1.25 mm, about 1.5 mm, about 1.75 mm, about 2 mm, about 2.25 mm, about 2.5 mm, about 2.75 mm, or about 3 mm. In other aspects of this embodiment, one sight mount hole is located from the other sight mount hole by a sight mount hole offset distance of, e.g., at least 0.25 mm, at least 0.5 mm, at least 0.75 mm, at least 1 mm, at least 1.25 mm, at least 1.5 mm, at least 1.75 mm, at least 2 mm, at least 2.25 mm, at least 2.5 mm, at least 2.75 mm, or at least 3 mm. In yet other aspects of this embodiment, one slide mount hole is located from the other sight mount hole by a sight mount hole offset distance of, e.g., at most 0.25 mm, at most 0.5 mm, at most 0.75 mm, at most 1 mm, at most 1.25 mm, at most 1.5 mm, at most 1.75 mm, at most 2 mm, at most 2.25 mm, at most 2.5 mm, at most 2.75 mm, or at most 3 mm. In still other aspects of this embodiment, one sight mount hole is located from the other sight mount hole by a sight mount hole offset distance of, e.g., about 0.0 mm to about 0.5 mm, about 0.0 mm to about 0.75 mm, about 0.0 mm to about 1 mm, about 0.0 mm to about 1.25 mm, 0.0 mm to about 1.5 mm, about 0.0 mm to about 1.75 mm, about 0.0 mm to about 2 mm, about 0.0 mm to about 2.25 mm, 0.0 mm to about 2.5 mm, about 0.0 mm to about 2.75 mm, or about 0.0 mm to about 3 mm, about 0.25 mm to about 0.5 mm, about 0.25 mm to about 0.75 mm, about 0.25 mm to about 1 mm, about 0.25 mm to about 1.25 mm, 0.25 mm to about 1.5 mm, about 0.25 mm to about 1.75 mm, about 0.25 mm to about 2 mm, about 0.25 mm to about 2.25 mm, 0.25 mm to about 2.5 mm, about 0.25 mm to about 2.75 mm, or about 0.25 mm to about 3 mm, about 0.5 mm to about 0.75 mm, about 0.5 mm to about 1 mm, about 0.5 mm to about 1.25 mm, 0.5 mm to about 1.5 mm, about 0.5 mm to about 1.75 mm, about 0.5 mm to about 2 mm, about 0.5 mm to about 2.25 mm, 0.5 mm to about 2.5 mm, about 0.5 mm to about 2.75 mm, or about 0.5 mm to about 3 mm, about 0.75 mm to about 1 mm, about 0.75 mm to about 1.25 mm, 0.75 mm to about 1.5 mm, about 0.75 mm to about 1.75 mm, about 0.75 mm to about 2 mm, about 0.75 mm to about 2.25 mm, 0.75 mm to about 2.5 mm, about 0.75 mm to about 2.75 mm, or about 0.75 mm to about 3 mm, about 1 mm to about 1.25 mm, 1 mm to about 1.5 mm, about 1 mm to about 1.75 mm, about 1 mm to about 2 mm, about 1 mm to about 2.25 mm, 1 mm to about 2.5 mm, about 1 mm to about 2.75 mm, or about 1 mm to about 3 mm, about 1.5 mm to about 2 mm, about 1.5 mm to about 2.5 mm, about 1.5 mm to about 3 mm, about 2 mm to about 2.5 mm, about 2 mm to about 3 mm, or about 2.5 mm to about 3 mm.

In other aspects of this embodiment, a sight mount hole has a central x-axis distance of, e.g., about 0.25 mm, about 0.5 mm, about 0.75 mm, about 1 mm, about 1.25 mm, about 1.5 mm, about 1.75 mm, or about 2 mm from the central x-axis distance. In other aspects of this embodiment, a sight mount hole has a central x-axis distance of, e.g., at least 0.25 mm, at least 0.5 mm, at least 0.75 mm, at least 1 mm, at least 1.25 mm, at least 1.5 mm, at least 1.75 mm, or at least 2 mm from the central x-axis distance. In yet other aspects of this embodiment, a sight mount hole has a central x-axis distance of, e.g., at most 0.25 mm, at most 0.5 mm, at most 0.75 mm, at most 1 mm, at most 1.25 mm, at most 1.5 mm, at most 1.75 mm, or at most 2 mm from the central x-axis distance. In still other aspects of this embodiment, a sight mount hole has a central x-axis distance of, e.g., about 0.0 mm to about 0.5 mm, about 0.0 mm to about 0.75 mm, about 0.0 mm to about 1 mm, about 0.0 mm to about 1.25 mm, 0.0 mm to about 1.5 mm, about 0.0 mm to about 1.75 mm, about 0.0 mm to about 2 mm, about 0.25 mm to about 0.5 mm, about 0.25 mm to about 0.75 mm, about 0.25 mm to about 1 mm, about 0.25 mm to about 1.25 mm, 0.25 mm to about 1.5 mm, about 0.25 mm to about 1.75 mm, about 0.25 mm to about 2 mm, about 0.5 mm to about 0.75 mm, about 0.5 mm to about 1 mm, about 0.5 mm to about 1.25 mm, 0.5 mm to about 1.5 mm, about 0.5 mm to about 1.75 mm, about 0.5 mm to about 2 mm, about 0.75 mm to about 1 mm, about 0.75 mm to about 1.25 mm, 0.75 mm to about 1.5 mm, about 0.75 mm to about 1.75 mm, about 0.75 mm to about 2 mm, about 1 mm to about 1.25 mm, 1 mm to about 1.5 mm, about 1 mm to about 1.75 mm, about 1 mm to about 2 mm, or about 1.5 mm to about 2 mm from the central x-axis distance.

Aspects of the present specification disclose a method of modifying a firearm to properly receive a slide mount disclosed herein. A method to modify a firearm to receive a sight mount disclosed herein includes disassembling a firearm to remove rear iron sight and associated components from a slide, removing a ledge or a portion thereof from a slide, modifying a slide by drilling and tapping two slide mount screw holes, modifying a slide housing by drilling holes for the slide mount holes and sight mount holes, securing the sight mount to the modified slide, reassembly the firearm, an securing the sight to the sight mount disclosed herein.

Figure 10:
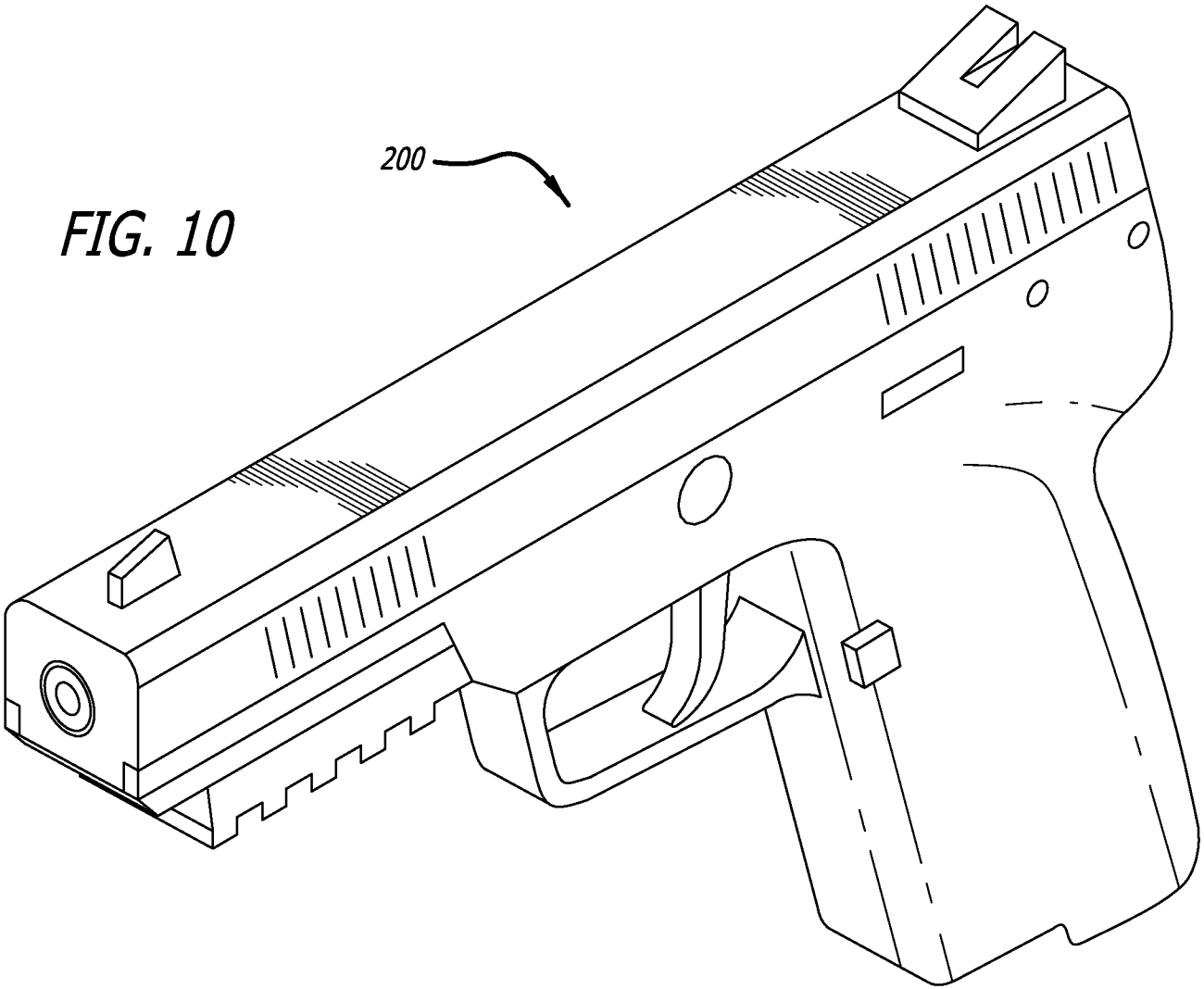
FIG. 10 is top front perspective view a firearm.
Figure 11:
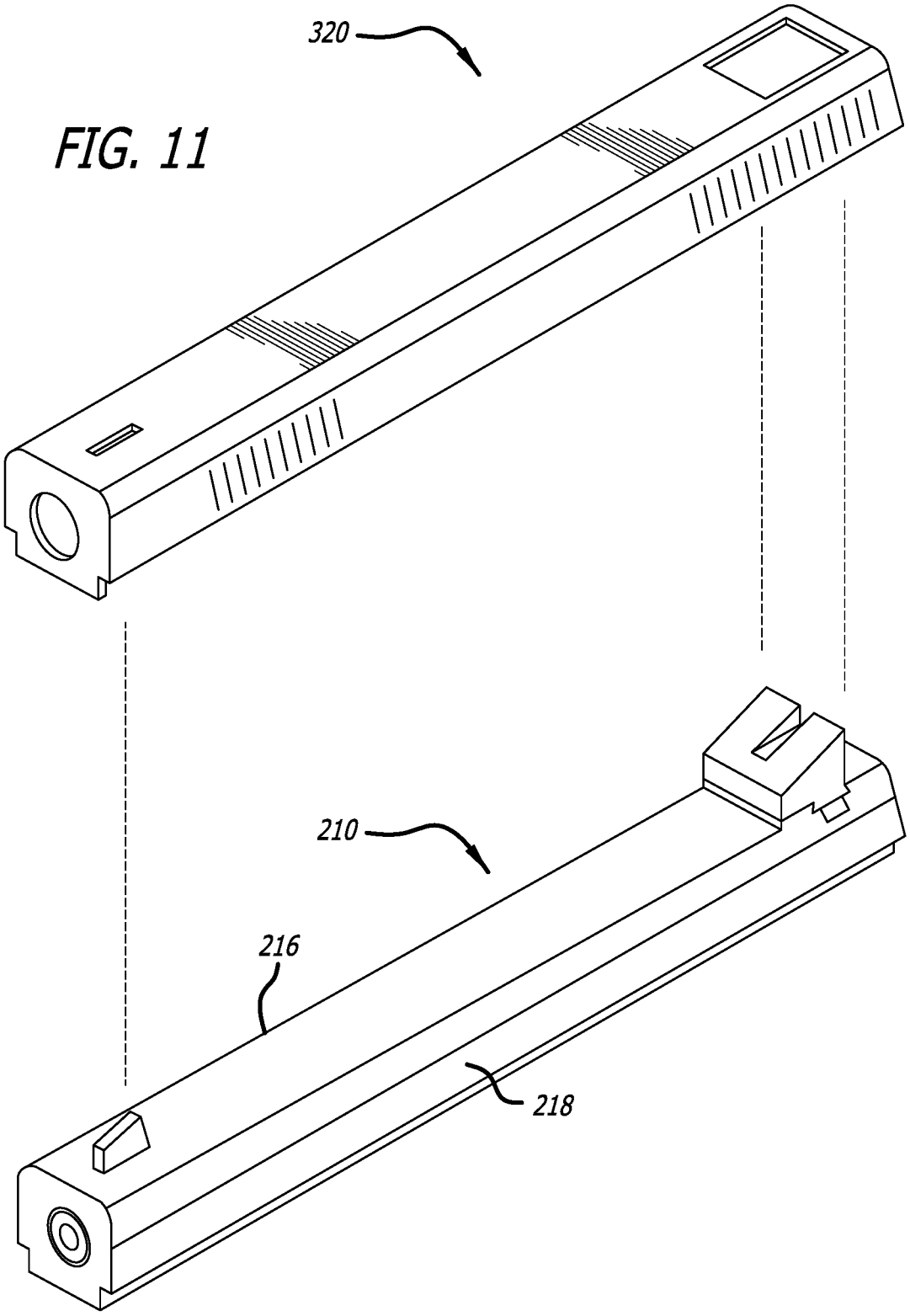
FIG. 11 is top front perspective view a slide and slide housing of a firearm.
Figure 12:
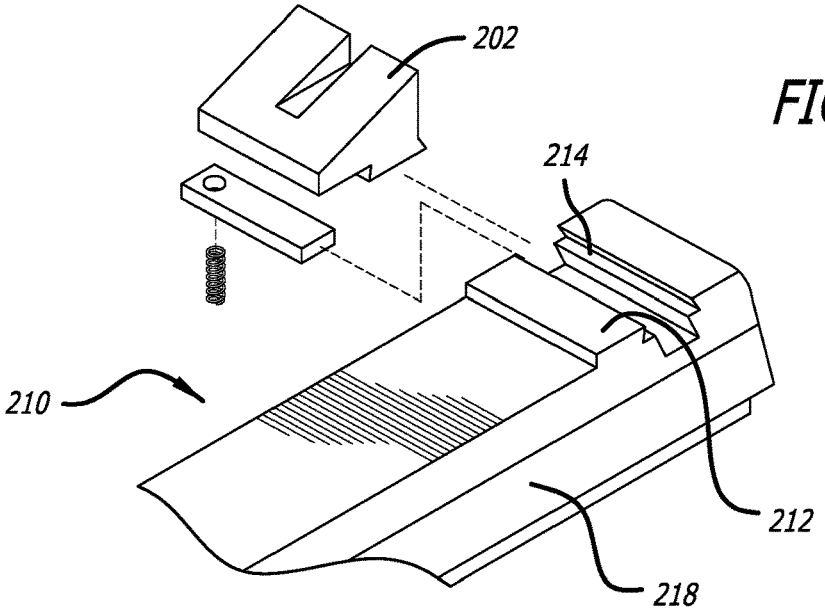
FIG. 12 is top front perspective view a slide a firearm showing removal of a rear iron sight.

A firearm is disassembled into its component parts in order to gain access to the slide and slide housing and for removal of the rear sight and optionally associated rear sight components. For example, in one embodiment, as shown in FIGS. 10 & 11 disassembly of firearm 200 gains assess to slide 210 and slide housing 320. As shown in FIG. 12, once slide 210 is removed from firearm 200, rear sight 202 is then removed from dovetail sight mount 204 (an associated rear sight component) located on slide 210. Dovetail sight mount 204 is then removed from the slide 210. In one embodiment, a dovetail mount is removed by physically removing the dovetail mount by sliding it out of its grooves. In an aspect of this embodiment, a dovetail mount is physically removed by striking the mount with a punch that slides the mount out of the grooves of the slide.

Figure 13:
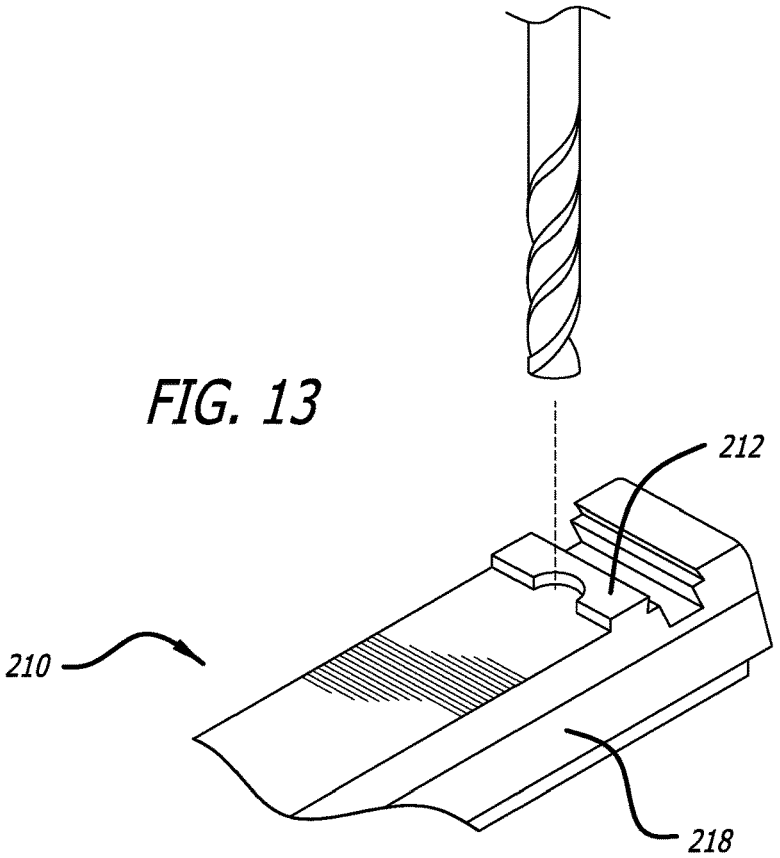
FIG. 13 is top front perspective view a slide modified according to a method disclosed herein and showing modification of the slide in preparation of creating a slide mount screw hole.

Once the rear sight and optionally associated rear sight components are removed, a slide is then optionally modified to remove any features of a slide that could interfere with creating a slide mount screw hole or the proper attachment of a sight mount disclosed herein. In one embodiment, a slide is modified by removing a ledge or a portion thereof located forward of the location where the rear sight and associated rear sight components were located. For example, as shown in FIG. 13, a portion of a forward ledge 212 located forward of a dovetail mount groove 214 is removed to prepare an area for the subsequent creation of a slide mount screw hole. In an aspect of this embodiment, a ledge is entirely removed in a manner that the area where the ledge was located is flush with surrounding area of the slide. In another aspect of this embodiment, a remnant of the ledge remains. A remnant of a ledge can be present so long as the remnant does not adversely interfere with the creation of a slide mount screw hole or the placement of a sight mount disclosed herein.

In aspects of this embodiment, a remnant of a ledge remains that has a height of, e.g., about 0.25 mm, about 0.5 mm, about 0.75 mm, about 1 mm, about 1.25 mm, about 1.5 mm, about 1.75 mm, about 2 mm, about 2.25 mm, about 2.5 mm, about 2.75 mm, or about 3 mm. In other aspects of this embodiment, a remnant of a ledge remains that has a height of, e.g., at least 0.25 mm, at least 0.5 mm, at least 0.75 mm, at least 1 mm, at least 1.25 mm, at least 1.5 mm, at least 1.75 mm, at least 2 mm, at least 2.25 mm, at least 2.5 mm, at least 2.75 mm, or at least 3 mm. In yet other aspects of this embodiment, a remnant of a ledge remains that has a height of, e.g., at most 0.25 mm, at most 0.5 mm, at most 0.75 mm, at most 1 mm, at most 1.25 mm, at most 1.5 mm, at most 1.75 mm, at most 2 mm, at most 2.25 mm, at most 2.5 mm, at most 2.75 mm, or at most 3 mm. In still other aspects of this embodiment, a remnant of a ledge remains that has a height of, e.g., about 0.0 mm to about 0.5 mm, about 0.0 mm to about 0.75 mm, about 0.0 mm to about 1 mm, about 0.0 mm to about 1.25 mm, 0.0 mm to about 1.5 mm, about 0.0 mm to about 1.75 mm, about 0.0 mm to about 2 mm, about 0.0 mm to about 2.25 mm, 0.0 mm to about 2.5 mm, about 0.0 mm to about 2.75 mm, or about 0.0 mm to about 3 mm, about 0.25 mm to about 0.5 mm, about 0.25 mm to about 0.75 mm, about 0.25 mm to about 1 mm, about 0.25 mm to about 1.25 mm, 0.25 mm to about 1.5 mm, about 0.25 mm to about 1.75 mm, about 0.25 mm to about 2 mm, about 0.25 mm to about 2.25 mm, 0.25 mm to about 2.5 mm, about 0.25 mm to about 2.75 mm, or about 0.25 mm to about 3 mm, about 0.5 mm to about 0.75 mm, about 0.5 mm to about 1 mm, about 0.5 mm to about 1.25 mm, 0.5 mm to about 1.5 mm, about 0.5 mm to about 1.75 mm, about 0.5 mm to about 2 mm, about 0.5 mm to about 2.25 mm, 0.5 mm to about 2.5 mm, about 0.5 mm to about 2.75 mm, or about 0.5 mm to about 3 mm, about 0.75 mm to about 1 mm, about 0.75 mm to about 1.25 mm, 0.75 mm to about 1.5 mm, about 0.75 mm to about 1.75 mm, about 0.75 mm to about 2 mm, about 0.75 mm to about 2.25 mm, 0.75 mm to about 2.5 mm, about 0.75 mm to about 2.75 mm, or about 0.75 mm to about 3 mm, about 1 mm to about 1.25 mm, 1 mm to about 1.5 mm, about 1 mm to about 1.75 mm, about 1 mm to about 2 mm, about 1 mm to about 2.25 mm, 1 mm to about 2.5 mm, about 1 mm to about 2.75 mm, or about 1 mm to about 3 mm, about 1 mm to about 1.5 mm, about 1 mm to about 2 mm, about 1 mm to about 2.5 mm, about 1 mm to about 3 mm, about 1.5 mm to about 2 mm, about 1.5 mm to about 2.5 mm, about 1.5 mm to about 3 mm, about 2 mm to about 2.5 mm, about 2 mm to about 3 mm, or about 2.5 mm to about 3 mm.

After removal of any slide features that could interfere with creating a slide mount screw hole or the proper attachment of a sight mount disclosed herein, a slide is modified to create slide mount screw holes. The location of a slide mount screw hole is positioned so that a slide mount screw hole will align with its corresponding slide mount hole from a sight mount disclosed herein. In an embodiment, two or more slide mount screw holes are created in a slide. In an aspect of this embodiment, two slide mount screw holes are created in a slide.

A slide mount screw hole is produced by first drilling a hole in the slide and then tapping this drilled hole. A tap cuts or forms a thread on the inside surface of a hole, creating a female surface to receive a screw. Tapping may either be achieved by a hand tapping by using a set of taps (first tap, second tap & final (finish) tap) or using a machine to do the tapping, such as a lathe, radial drilling machine, bench type drill machine, pillar type drill machine, vertical milling machines, HMCs, VMCs. Machine tapping is faster, and generally more accurate because human error is eliminated. Final tapping is achieved with single tap. In aspect of this embodiment, a slide mount screw hole is tapped to a machine screw gauge of, e.g., 000, 00, 0, 1, 2, 3, 4, 5, 6, 7, 8, 9, 10, 11, 12, 13, 14, 15, 16, 17, 18, 19, or 20. In other aspect of this embodiment, a slide mount screw hole is tapped to accommodate a diameter of, e.g., 0.0625 inches, 0.0781 inches, 0.9375 inches, 0.1094 inches, 0.125 inches, 0.1368 inches, 0.1407 inches, 0.1563 inches, 0.164 inches, 0.1719 inches, 0.1875 inches, 0.2031 inches, 0.2188 inches, 0.2344 inches, or 0.250 inches. In other aspects, a slide mount screw hole is tapped to accommodate a tread of ¼×20, 5/16×18, 3/8×16, 7/16×14, ½×13, 5/8×11, ¾×10, 7/8×9, or 1×8. In yet other aspects, a slide mount screw hole is tapped to accommodate a tread of ¼×28, 5/16×24, 3/8×24, 7/16×20, ½×20, 5/8×18, ¾×16, 7/8×14, or 1×14.

Figure 14:
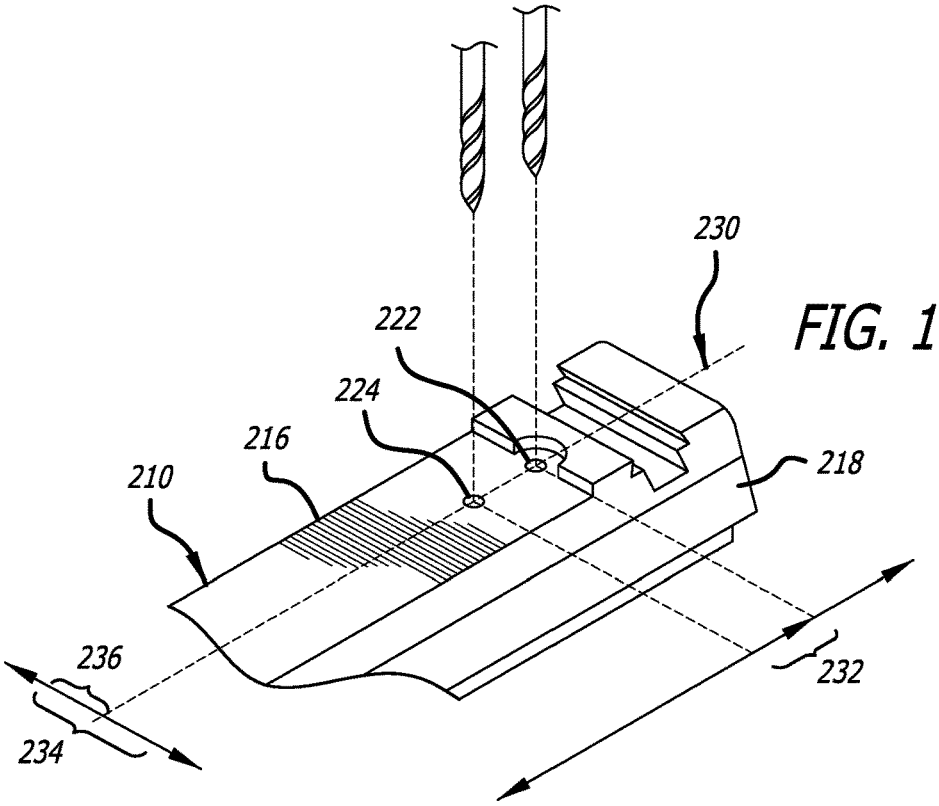
FIGS. 14 is top front perspective view a slide modified according to a method disclosed herein and showing creation of a slide mount screw hole.

The location of slide mount screw holes from each other is defined by a slide mount screw hole separation distance and a slide mount screw hole offset distance. A slide mount screw hole separation distance is the distance from one slide mount screw hole to the other slide mount screw hole measured in a direction running parallel to the central y-axis of the slide. A central y-axis of a slide bisects the slide of a firearm and runs in the direction parallel to the recoil direction of the slide. As shown in FIG. 14, central y-axis 230 bisects sight mount 210 and runs in the direction parallel to the right 216 and left 218 sides of slide 210. The location of the slide mount screw holes can be of any reasonable slide mount screw hole separation distance so long as the slide mount screw hole separation distance does not impede the operation or structural integrity of the firearm.

In aspects of this embodiment, a slide mount screw hole separation distance between two slide mount screw holes is, e.g., about 11 mm, about 12 mm, about 13 mm, about 14, mm, about 15 mm, about 16 mm, about 17 mm, about 18 mm, about 19 mm, or about 20 mm. In other aspects of this embodiment, a slide mount screw hole separation distance between two slide mount screw holes is, e.g., at least 11 mm, at least 12 mm, at least 13 mm, at least 14, mm, at least 15 mm, at least 16 mm, at least 17 mm, at least 18 mm, at least 19 mm, or at least 20 mm. In yet other aspects of this embodiment, a slide mount screw hole separation distance between two slide mount screw holes is, e.g., at most 11 mm, at most 12 mm, at most 13 mm, at most 14, mm, at most 15 mm, at most 16 mm, at most 17 mm, at most 18 mm, at most 19 mm, or at most 20 mm. In yet other aspects of this embodiment, a slide mount screw hole separation distance between two slide mount screw holes is, e.g., about 11 mm to about 12 mm, about 11 mm to about 13 mm, about 11 mm to about 14 mm, about 11 mm to about 15 mm, about 11 mm to about 16 mm, about 11 mm to about 17 mm, about 11 mm to about 18 mm, about 11 mm to about 19 mm, about 11 mm to about 20 mm, about 12 mm to about 13 mm, about 12 mm to about 14 mm, about 12 mm to about 15 mm, about 12 mm to about 16 mm, about 12 mm to about 17 mm, about 12 mm to about 18 mm, about 12 mm to about 19 mm, about 12 mm to about 20 mm, about 13 mm to about 14 mm, about 13 mm to about 15 mm, about 13 mm to about 16 mm, about 13 mm to about 17 mm, about 13 mm to about 18 mm, about 13 mm to about 19 mm, about 13 mm to about 20 mm, about 14 mm to about 15 mm, about 14 mm to about 16 mm, about 14 mm to about 17 mm, about 14 mm to about 18 mm, about 14 mm to about 19 mm, about 14 mm to about 20 mm, about 15 mm to about 16 mm, about 15 mm to about 17 mm, about 15 mm to about 18 mm, about 15 mm to about 19 mm, about 15 mm to about 20 mm, about 16 mm to about 17 mm, about 16 mm to about 18 mm, about 16 mm to about 19 mm, about 16 mm to about 20 mm, about 17 mm to about 18 mm, about 17 mm to about 19 mm, about 17 mm to about 20 mm, about 18 mm to about 19 mm, about 18 mm to about 20 mm, or about 19 mm to about 20 mm.

In aspects of this embodiment, a slide mount screw hole separation distance between two slide mount screw holes is, e.g., about 3 mm, about 4 mm, about 5 mm, about 6 mm, about 7 mm, about 8 mm, about 9 mm or about 10 mm. In other aspects of this embodiment, a slide mount screw hole separation distance between two slide mount screw holes is, e.g., at least 3 mm, at least 4 mm, at least 5 mm, at least 6 mm, at least 7 mm, at least 8 mm, at least 9 mm or at least 10 mm. In yet other aspects of this embodiment, a slide mount screw hole separation distance between two slide mount screw holes is, e.g., at most 3 mm, at most 4 mm, at most 5 mm, at most 6 mm, at most 7 mm, at most 8 mm, at most 9 mm or at most 10 mm. In still other aspects of this embodiment, a slide mount screw hole separation distance between two slide mount screw holes is, e.g., about 3 mm to about 4 mm, about 3 mm to about 5 mm, about 3 mm to about 6 mm, about 3 mm to about 7 mm, about 3 mm to about 8 mm, about 3 mm to 9 mm, about 3 mm to about 10 mm, about 4 mm to about 5 mm, about 4 mm to about 6 mm, about 4 mm to about 7 mm, about 4 mm to about 8 mm, about 4 mm to 9 mm, about 4 mm to about 10 mm, about 5 mm to about 7 mm, about 5 mm to about 8 mm, about 5 mm to 9 mm, about 5 mm to about 10 mm, about 6 mm to about 7 mm, about 6 mm to about 8 mm, about 6 mm to 9 mm, about 6 mm to about 10 mm, about 7 mm to about 8 mm, about 7 mm to 9 mm, about 7 mm to about 10 mm, about 8 mm to 9 mm, about 8 mm to about 10 mm, or about 9 mm to about 10 mm.

In another aspect of this embodiment, two slide mount screw holes are created in the region of a take down hole of a slide. In an embodiment, and referring to FIG. 14, a slide mount screw hole separation distance 232 between slide mount screw hole 222 and slide mount screw hole 224 is about 6 mm. In one embodiment, slide mount screw holes are located parallel to each other along a central y-axis of a slide. In an aspect of this embodiment, and referring to FIG. 14, slide mount screw holes 222 and 224 are located parallel to each other along central y-axis 230 of slide 210.

A slide mount screw hole offset distance is the distance from one slide mount screw hole to the other slide mount screw hole measured in a direction perpendicular to central y-axis of the slide. For example, as shown in FIG. 14, sight mount offset distance 234 is depicted. However, the location of the slide mount screw holes can be of any reasonable slide mount screw hole offset distance so long as the slide mount screw hole offset distance does not impede the operation or structural integrity of the firearm.

In one embodiment, the slide mount screw holes have a slide mount screw hole offset distance of zero. In an aspect of this embodiment, the slide mount screw holes have a slide mount screw hole offset distance of zero and are aligned on the central y-axis of the slide. In another aspect of this embodiment, the slide mount screw holes have a slide mount screw hole offset distance of zero and are aligned on the central y-axis of the slide with one slide mount screw hole located on one side of the take down hole and the other slide mount screw hole located on the opposite side of the take down hole. In an embodiment, and referring to FIG. 14, an exemplary sight mount hole offset distance 234 between sight mount hole 222 and sight mount hole 224 is zero.

In one embodiment, the slide mount screw holes have a slide mount screw hole offset distance of greater than zero. In an aspect of this embodiment, the slide mount screw holes have a slide mount screw hole offset distance of greater than zero and are aligned on the central y-axis of the slide. In another aspect of this embodiment, the slide mount screw holes have a slide mount screw hole offset distance of greater than zero and are aligned on the central y-axis of the slide with one slide mount screw hole located on one side of the take down hole and the other slide mount screw hole located on the opposite side of the take down hole.

In one embodiment, the slide mount screw holes have a slide mount screw hole offset distance of greater than zero, with a central y-axis distance of each slide mount screw hole being equal to the other slide mount screw hole. A central y-axis distance is the distance of a slide mount screw hole from the central y-axis of the slide in a perpendicular direction. For example, as shown in FIG. 14, central y-axis distance 236 is depicted. In one embodiment, slide mount screw holes have a slide mount screw hole offset distance of greater than zero, with a central y-axis distance of each slide mount screw hole being equal to the other slide mount screw hole with one slide mount screw hole located on one side of the take down hole and the other slide mount screw hole located on the opposite side of the take down hole. For example, when slide mount screw hole 222 and slide mount screw hole 224 have a slide mount hole offset distance 234 of 2 mm with each of slide mount screw holes 222 and 224 being 1 mm from central y-axis 230, indicating that central y-axis distance 236 for each slide mount hole is equal to one another, i.e., 1 mm. In an embodiment, and referring to FIG. 14, slide mount screw hole 222 and slide mount screw hole 224 have a slide mount screw hole offset distance 234 of 0 mm with each of slide mount holes 222 and 224 being 0 mm from central y-axis 230, indicating that central y-axis distance 236 for each slide mount screw hole is equal to one another, i.e., 0 mm.

In one embodiment, the slide mount screw holes have a slide mount screw hole offset distance of greater than zero, with a central y-axis distance of each slide mount screw hole being different from the other slide mount screw hole. In an aspect of this embodiment, the slide mount screw holes have a slide mount screw hole offset distance of greater than zero, with a central y-axis distance of each slide mount screw hole being different from other slide mount screw hole with one slide mount screw hole located on one side of the take down hole and the other slide mount screw hole located on the opposite side of the take down hole.

In other aspects of this embodiment, one slide mount screw hole is located from the other slide mount screw hole by a slide mount screw hole offset distance of, e.g., about 0.25 mm, about 0.5 mm, about 0.75 mm, about 1 mm, about 1.25 mm, about 1.5 mm, about 1.75 mm, about 2 mm, about 2.25 mm, about 2.5 mm, about 2.75 mm, or about 3 mm. In other aspects of this embodiment, one slide mount screw hole is located from the other slide mount screw hole by a slide mount screw hole offset distance of, e.g., at least 0.25 mm, at least 0.5 mm, at least 0.75 mm, at least 1 mm, at least 1.25 mm, at least 1.5 mm, at least 1.75 mm, at least 2 mm, at least 2.25 mm, at least 2.5 mm, at least 2.75 mm, or at least 3 mm. In yet other aspects of this embodiment, one slide mount screw hole is located from the other slide mount screw hole by a slide mount screw hole offset distance of, e.g., at most 0.25 mm, at most 0.5 mm, at most 0.75 mm, at most 1 mm, at most 1.25 mm, at most 1.5 mm, at most 1.75 mm, at most 2 mm, at most 2.25 mm, at most 2.5 mm, at most 2.75 mm, or at most 3 mm. In still other aspects of this embodiment, one slide mount screw hole is located from the other slide mount screw hole by a slide mount screw hole offset distance of, e.g., about 0.0 mm to about 0.5 mm, about 0.0 mm to about 0.75 mm, about 0.0 mm to about 1 mm, about 0.0 mm to about 1.25 mm, 0.0 mm to about 1.5 mm, about 0.0 mm to about 1.75 mm, about 0.0 mm to about 2 mm, about 0.0 mm to about 2.25 mm, 0.0 mm to about 2.5 mm, about 0.0 mm to about 2.75 mm, or about 0.0 mm to about 3 mm, about 0.25 mm to about 0.5 mm, about 0.25 mm to about 0.75 mm, about 0.25 mm to about 1 mm, about 0.25 mm to about 1.25 mm, 0.25 mm to about 1.5 mm, about 0.25 mm to about 1.75 mm, about 0.25 mm to about 2 mm, about 0.25 mm to about 2.25 mm, 0.25 mm to about 2.5 mm, about 0.25 mm to about 2.75 mm, or about 0.25 mm to about 3 mm, about 0.5 mm to about 0.75 mm, about 0.5 mm to about 1 mm, about 0.5 mm to about 1.25 mm, 0.5 mm to about 1.5 mm, about 0.5 mm to about 1.75 mm, about 0.5 mm to about 2 mm, about 0.5 mm to about 2.25 mm, 0.5 mm to about 2.5 mm, about 0.5 mm to about 2.75 mm, or about 0.5 mm to about 3 mm, about 0.75 mm to about 1 mm, about 0.75 mm to about 1.25 mm, 0.75 mm to about 1.5 mm, about 0.75 mm to about 1.75 mm, about 0.75 mm to about 2 mm, about 0.75 mm to about 2.25 mm, 0.75 mm to about 2.5 mm, about 0.75 mm to about 2.75 mm, or about 0.75 mm to about 3 mm, about 1 mm to about 1.25 mm, 1 mm to about 1.5 mm, about 1 mm to about 1.75 mm, about 1 mm to about 2 mm, about 1 mm to about 2.25 mm, 1 mm to about 2.5 mm, about 1 mm to about 2.75 mm, or about 1 mm to about 3 mm, about 1.5 mm to about 2 mm, about 1.5 mm to about 2.5 mm, about 1.5 mm to about 3 mm, about 2 mm to about 2.5 mm, about 2 mm to about 3 mm, or about 2.5 mm to about 3 mm.

In other aspects of this embodiment, a slide mount screw hole has a central y-axis distance of, e.g., about 0.25 mm, about 0.5 mm, about 0.75 mm, about 1 mm, about 1.25 mm, about 1.5 mm, about 1.75 mm, or about 2 mm. In other aspects of this embodiment, a slide mount screw hole has a central y-axis distance of, e.g., at least 0.25 mm, at least 0.5 mm, at least 0.75 mm, at least 1 mm, at least 1.25 mm, at least 1.5 mm, at least 1.75 mm, or at least 2 mm. In yet other aspects of this embodiment, a slide mount screw hole has a central y-axis distance of, e.g., at most 0.25 mm, at most 0.5 mm, at most 0.75 mm, at most 1 mm, at most 1.25 mm, at most 1.5 mm, at most 1.75 mm, or at most 2 mm. In still other aspects of this embodiment, a slide mount screw hole has a central y-axis distance of, e.g., about 0.0 mm to about 0.5 mm, about 0.0 mm to about 0.75 mm, about 0.0 mm to about 1 mm, about 0.0 mm to about 1.25 mm, 0.0 mm to about 1.5 mm, about 0.0 mm to about 1.75 mm, about 0.0 mm to about 2 mm, about 0.25 mm to about 0.5 mm, about 0.25 mm to about 0.75 mm, about 0.25 mm to about 1 mm, about 0.25 mm to about 1.25 mm, 0.25 mm to about 1.5 mm, about 0.25 mm to about 1.75 mm, about 0.25 mm to about 2 mm, about 0.5 mm to about 0.75 mm, about 0.5 mm to about 1 mm, about 0.5 mm to about 1.25 mm, 0.5 mm to about 1.5 mm, about 0.5 mm to about 1.75 mm, about 0.5 mm to about 2 mm, about 0.75 mm to about 1 mm, about 0.75 mm to about 1.25 mm, 0.75 mm to about 1.5 mm, about 0.75 mm to about 1.75 mm, about 0.75 mm to about 2 mm, about 1 mm to about 1.25 mm, 1 mm to about 1.5 mm, about 1 mm to about 1.75 mm, about 1 mm to about 2 mm, or about 1.5 mm to about 2 mm.

Either before, concurrently or after modification of a slide, a slide housing is modified to create through holes. The number of through holes will correspond to the number of slide mount holes and sight mount holes present on a sight mount disclosed herein. The location of through hole are positioned so as to be in alignment with the slide mount holes and sight mount holes of a slight mount. Further, alignment of the through holes of a slide housing with the slide mount holes of a sight mount disclosed herein will also be in alignment with the slide mount screw holes of the slide to ensure proper attachment via a threaded screw. Through holes of a slide housing in alignment with the sight holes of a sight mount disclosed herein ensure proper attachment of a sight to a sight mount by facilitating complete and unencumbered passage of a threaded screw used to secure the sight to the sight mount. Though holes can be created in a slide housing by conventional means such as, e.g., drilling.

Figure 15:
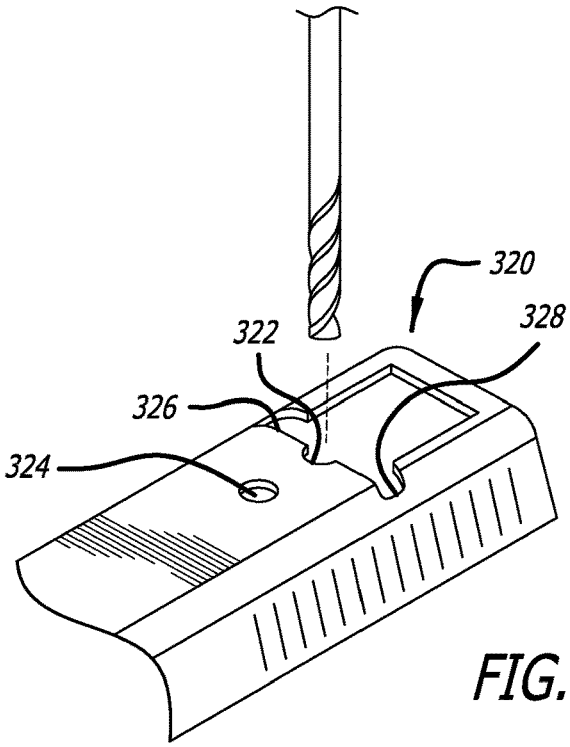
FIG. 15 is top front perspective view a slide housing modified according to a method disclosed herein and showing creation of a through hole.

In an embodiment, two or more through holes are created in a slide housing. In an aspect of this embodiment, four through holes are created in a slide housing. In another aspect of this embodiment, and referring to FIG. 15, slide housing 320 has two through holes 322 and 324 that will align with slide mount holes 22 and 24 of slide mount 10 and two through holes 326 and 328 that will align with sight mount holes 26 and 28.

Figure 16:
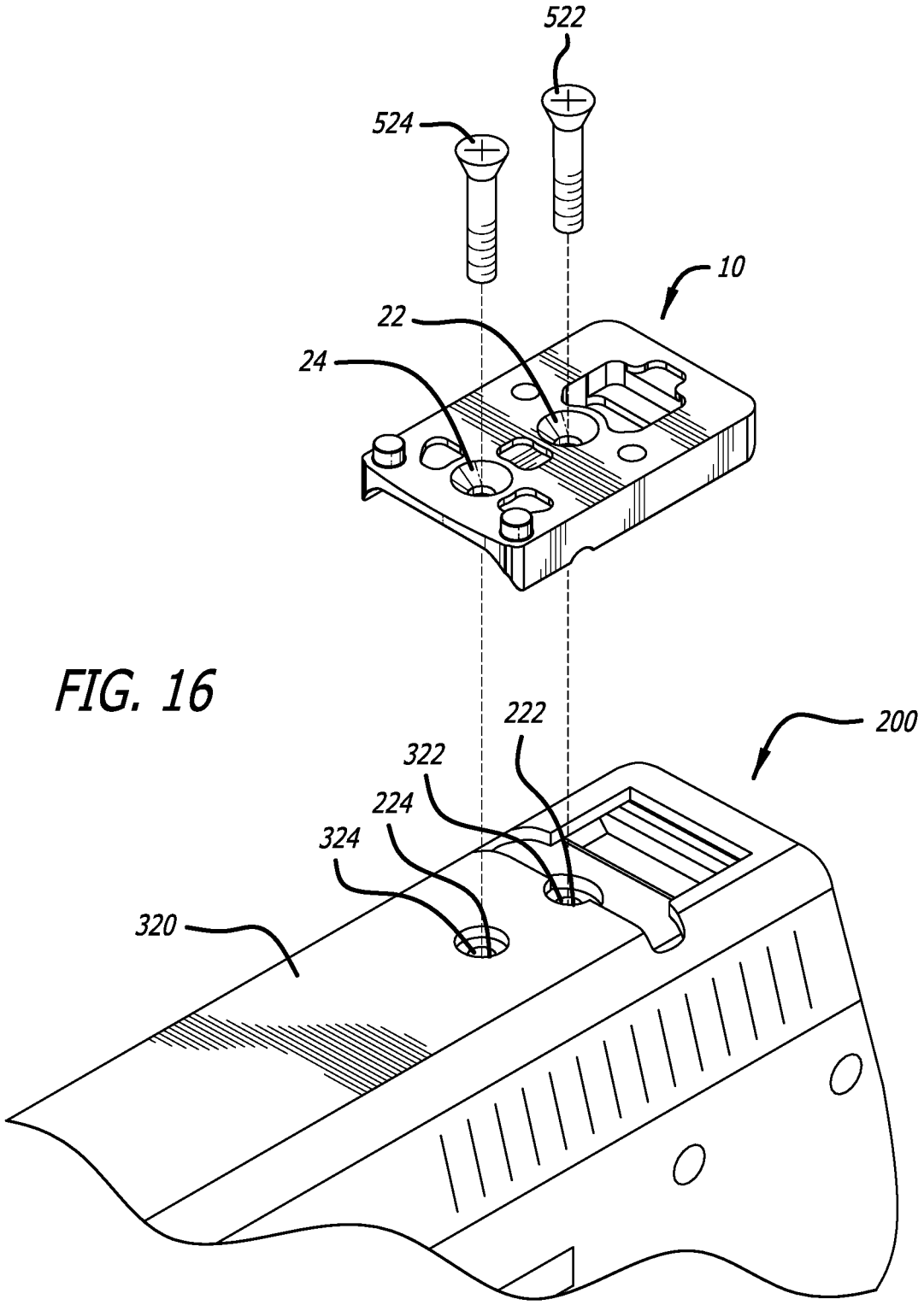
FIG. 16 is top front perspective view a firearm modified according to a method disclosed herein and showing attachment of a slight mount disclosed herein to the firearm.

After modification of a slide and a slide housing is complete, a firearm is then reassembled. Once reassembled, a sight mount disclosed herein is secured to a firearm. This can be done by placing a slight mount on top of a slide housing in a manner that aligns the slide mount holes of a slight mount with the through holes of a slide housing and the slide mount screw holes of a slide and securing a slight mount to a modified slide with threaded screws. For example, as shown in FIG. 16 threaded screws 522 and 524 are place through slide mount holes 22 and 24 and though holes 322 and 324 and then screwed into slide mount screw holes 222 and 224. In one embodiment, and referring to FIGS. 3, 13 & 16, slide mount hole sleeve 42 of sight mount 22 is positioned against the contours of the area modified in ledge 212 of slide 210 to provide extra support from the recoil forces of the slide experienced by a slight mount disclosed herein during operation of the firearm. Securing a slight mount to a slide creates pressure between a slight mount and a slide housing to create a dust-resistant and water-resistant seal.

Figure 17:
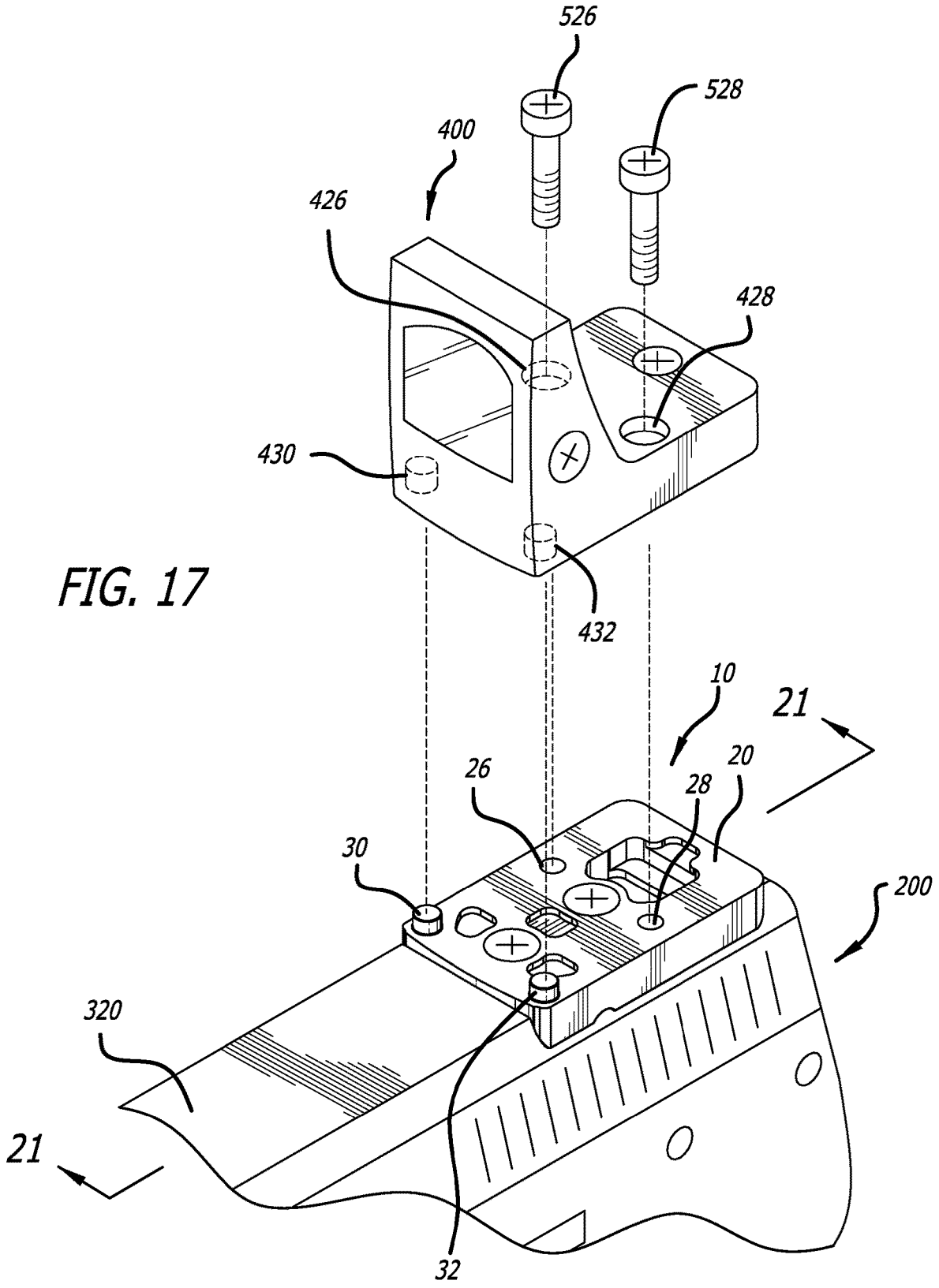
FIG. 17 is top front perspective view a firearm modified according to a method disclosed herein and showing attachment of an optical slight to a sight mount disclosed herein.
Figure 18:
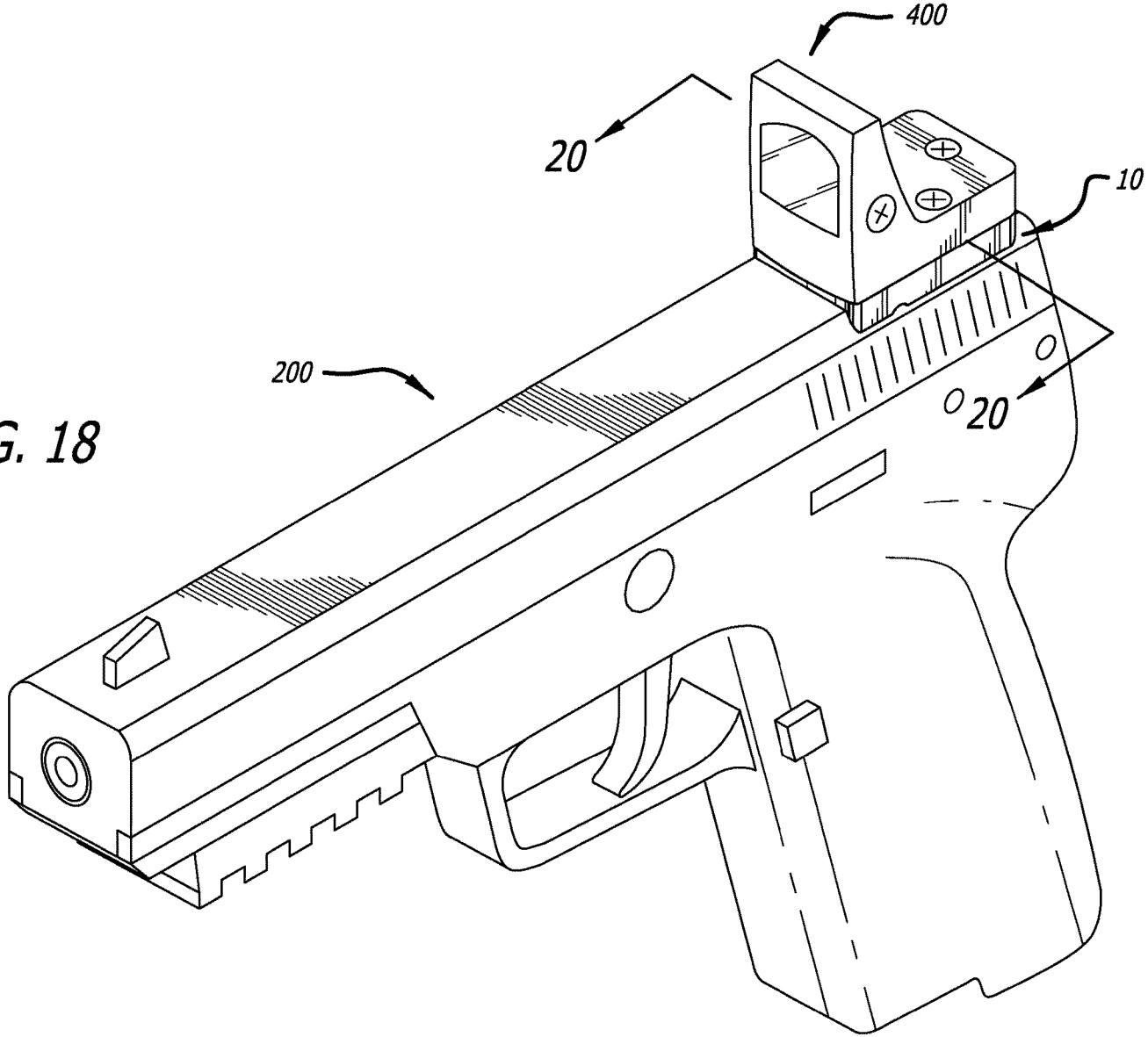
FIG. 18 is top front perspective view a firearm modified according to a method disclosed herein and comprising a sight mount disclosed herein and an optical slight.

Once the slight mount is secured to the firearm, a sight can be secured to the sight mount disclosed herein. This can be done by placing threaded screws through securing holes of a slight and screwing the threaded screws into sight mount holes of a sight mount disclosed herein to secure a sight to a sight mount. For example, as shown in FIG. 17 optical sight 400 is positioned on top surface 20 of sight mount 10 in a manner where mounting pins 30 and 32 are inserted into mounting pin holes 430 and 432 and securing holes 426 and 428 of optical sight 400 are aligned with sight mount holes 26 and 28 of sight mount 10. Threaded screws 526 and 528 are then place through securing holes 426 and 428 of optical sight 400 and then screwed into sight mount holes 26 and 28. In one embodiment, an optical sight mount is a laser sight. In an aspect of this embodiment, a laser sight is a TRIJICON® red dot laser sight.

The disclosed sight mount and method of firearm modification achieves a similar height over bore distance of a sight comparable to the iron sight it replaces. A height over bore distance is the distance from the center of the barrel of a firearm to the center of an optical scope. As shown in FIG. 19, height over bore distance 600 is shown for firearm 200 modified to receive and attached with sight mount 10 and optical sight 400. In aspects of this embodiment, the installed sight mount disclosed herein achieves a height over barrel distance of, e.g., about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, or about 20 mm. In other aspects of this embodiment, the installed sight mount disclosed herein achieves a height over barrel distance of, e.g., at least 5 mm, at least 6 mm, at least 7 mm, at least 8 mm, at least 9 mm, at least 10 mm, at least 11 mm, at least 12 mm, at least 13 mm, at least 14 mm, at least 15 mm, at least 16 mm, at least 17 mm, at least 18 mm, at least 19 mm, or at least 20 mm. In yet other aspects of this embodiment, the installed sight mount disclosed herein achieves a height over barrel distance of, e.g., at most 5 mm, at most 6 mm, at most 7 mm, at most 8 mm, at most 9 mm, at most 10 mm, at most 11 mm, at most 12 mm, at most 13 mm, at most 14 mm, at most 15 mm, at most 16 mm, at most 17 mm, at most 18 mm, at most 19 mm, or at most 20 mm. In still other aspects of this embodiment, the installed sight mount disclosed herein achieves a height over barrel distance of, e.g., about 5 mm to about 7.5 mm, about 5 mm to about 10 mm, about 5 mm to about 12.5 mm, about 5 mm to about 15 mm, about 5 mm to about 17.5 mm, about 5 mm to about 20 mm, about 7.5 mm to about 10 mm, about 7.5 mm to about 12.5 mm, about 7.5 mm to about 15 mm, about 7.5 mm to about 17.5 mm, about 7.5 mm to about 20 mm, about 10 mm to about 12.5 mm, about 10 mm to about 15 mm, about 10 mm to about 17.5 mm, about 10 mm to about 20 mm, about 12.5 mm to about 15 mm, about 12.5 mm to about 17.5 mm, about 12.5 mm to about 20 mm, about 15 mm to about 17.5 mm, about 15 mm to about 20 mm, or about 17.5 mm to about 20 mm.

In one embodiment, a firearm modified using a method disclosed herein negligibly increases the overall weight of a firearm installed with a sight mount disclosed herein.

In one embodiment, a firearm modified using a method disclosed herein decreases the overall weight of a firearm installed with a sight mount disclosed herein. In aspects of this embodiment, a firearm modified using a method disclosed herein decreases the overall weight of a firearm installed with a sight mount disclosed herein by, e.g., about 2 g, about 4 g, about 6 g, about 8 g, about 10 g, about 12 g, about 14 g, about 16 g, or about 18 g. In other aspects of this embodiment, a firearm modified using a method disclosed herein decreases the overall weight of a firearm installed with a sight mount disclosed herein by, e.g., at least 2 g, at least 4 g, at least 6 g, at least 8 g, at least 10 g, at least 12 g, at least 14 g, at least 16 g, or at least 18 g. In yet other aspects of this embodiment, a firearm modified using a method disclosed herein decreases the overall weight of a firearm installed with a sight mount disclosed herein by, e.g., at most 2 g, at most 4 g, at most 6 g, at most 8 g, at most 10 g, at most 12 g, at most 14 g, at most 16 g, or at most 18 g. In still other aspects of this embodiment, a firearm modified using a method disclosed herein decreases the overall weight of a firearm installed with a sight mount disclosed herein by, e.g., about 2 g to about 4 g, about 2 g to about 6 g, about 2 g to about 8 g, about 2 g to about 10 g, about 2 g to about 12 g, about 2 g to about 14 g, about 2 g to about 16 g, about 2 g to about 18 g, about 2 g to about 20 g, about 4 g to about 6 g, about 4 g to about 8 g, about 4 g to about 10 g, about 4 g to about 12 g, about 4 g to about 14 g, about 4 g to about 16 g, about 4 g to about 18 g, about 4 g to about 20 g, about 6 g to about 8 g, about 6 g to about 10 g, about 6 g to about 12 g, about 6 g to about 14 g, about 6 g to about 16 g, about 6 g to about 18 g, about 6 g to about 20 g, about 8 g to about 10 g, about 8 g to about 12 g, about 8 g to about 14 g, about 8 g to about 16 g, about 8 g to about 18 g, about 8 g to about 20 g, about 10 g to about 12 g, about 10 g to about 14 g, about 10 g to about 16 g, about 10 g to about 18 g, about 10 g to about 20 g, about 12 g to about 14 g, about 12 g to about 16 g, about 12 g to about 18 g, about 12 g to about 20 g, about 14 g to about 16 g, about 14 g to about 18 g, about 14 g to about 20 g, about 16 g to about 18 g, about 16 g to about 20 g, or about 18 g to about 20 g.

In one embodiment, a method disclosed herein increases a shear strength of an optical sight secured to a firearm modified using a disclosed method relative to the rear iron sight installed on an unmodified firearm. In aspects of this embodiment, an optical sight secured to a firearm modified using a disclosed method can withstand an increase in shear strength that is, e.g., about 1-fold more, about 2-fold more, about 3-fold more, about 4-fold more, or about 5-fold more, relative to the rear iron sight installed on an unmodified firearm. In other aspects of this embodiment, an optical sight secured to a firearm modified using a disclosed method can withstand an increase in shear strength that is, e.g., at least 1-fold more, at least 2-fold more, at least 3-fold more, at least 4-fold more, or at least 5-fold more, relative to the rear iron sight installed on an unmodified firearm. In yet other aspects of this embodiment, an optical sight secured to a firearm modified using a disclosed method can withstand an increase in shear strength that is, e.g., at most 1-fold more, at most 2-fold more, at most 3-fold more, at most 4-fold more, or at most 5-fold more, relative to the rear iron sight installed on an unmodified firearm. In still other aspects of this embodiment, an optical sight secured to a firearm modified using a disclosed method can withstand an increase in shear strength that is, e.g., about 1-fold to about 2-fold, about 1-fold to about 3-fold, about 1-fold to about 4-fold, about 1-fold to about 5-fold, about 2-fold to about 3-fold, about 2-fold to about 4-fold, about 2-fold to about 5-fold, about 3-fold to about 4-fold, about 3-fold to about 5-fold, or about 4-fold to about 5-fold.

In closing, it is to be understood that, although aspects of the present specification are highlighted by referring to specific embodiments, one skilled in the art will readily appreciate that these described embodiments are only illustrative of the principles of the subject matter disclosed herein. The specific embodiments are not intended to be exhaustive or to limit the invention to the precise forms disclosed. Therefore, it should be understood that the disclosed subject matter is in no way limited to a particular compound, composition, article, apparatus, methodology, protocol, and/or reagent, etc., described herein, unless expressly stated as such. In addition, those of ordinary skill in the art will recognize that certain changes, modifications, permutations, alterations, additions, subtractions and sub-combinations thereof can be made in accordance with the teachings herein without departing from the spirit of the present specification. It is therefore intended that the scope of the invention is not to be limited by this detailed description. Furthermore, it is intended that the following appended claims and claims hereafter introduced are interpreted to include all such changes, modifications, permutations, alterations, additions, subtractions and sub-combinations as are within their true spirit and scope.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified, thus fulfilling the written description of all Markush groups used in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement, and support for the phrases "consisting essentially of" and "consisting of."

All patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

Lastly, the terminology used herein is for the purpose of describing particular embodiments only and is not intended to limit the scope of the present invention, which is defined solely by the claims. Accordingly, the present invention is not limited to that precisely as shown and described.

The invention claimed is:

1. A method of modifying a firearm to receive a slide mount, the method comprising:

a) removing a ledge or a portion thereof from a slide;

b) modifying a slide by drilling and tapping two slide mount screw holes; and c) modifying a slide housing by drilling holes for the slide mount holes and sight mount holes, p1 wherein steps (a) to (c) can be performed in any order.

2. The method of claim 1 further comprising, prior to steps (a) to (c), disassembling a firearm to remove rear iron sight and associated components from a slide.

3. The method of claim 1 further comprising, after steps (a) to (c), securing the sight mount to the modified slide.

4. The method of claim 3, wherein after the sight mount is secured, reassembling the firearm.

5. The method of claim 4, wherein after the firearm is reassembled, securing a sight to the sight mount.

6. The method of claim 5, wherein the sight is an optical sight.

7. The method of claim 6, wherein the optical sight is a laser sight.

8. The method of claim 1, wherein the firearm is a rifle or a handgun.

9. The method of claim 1, wherein the sight mount is rectangular in shape with length, width and height dimensions and comprising:

a top surface, the top surface comprising two slide mount holes, two sight mount holes and weight-reducing depressions;

a bottom surface, the bottom surface comprising weight-reducing depressions and being conformed to the contours of an area of the firearm where the sight mount will be secured, a front side and a rear side, the front and the rear sides both having a curvilinear bottom edge conforming to the contours of an area of the firearm where the sight mount will be secured;

a right side and a left side.

10. The method of claim 1, wherein the two slide mount holes are located in parallel to each other and aligned on a central axis bisecting the sight mount and parallel to the right side.

11. The method of claim 10, wherein a slide mount hole separation distance between the two slide mount holes is about 9 mm to about 15 mm.

12. The method of claim 11, wherein a slide mount hole separation distance between the two slide mount holes is about 10 mm to about 14 mm.

13. The method of claim 1, wherein the two sight mount holes are located in parallel to each other along an axis running parallel to the rear side.

14. The method of claim 13, wherein a sight mount hole separation distance between the two sight mount holes is about 4 mm to about 10 mm.

15. The method of claim 14, wherein a sight mount hole separation distance between the two sight mount holes is about 5 mm to about 9 mm.

16. The method of claim 1, wherein the length of a sight mount is about 25 mm to about 50 mm.

17. The method of claim 1, wherein the width of a sight mount is about 15 mm to about 35 mm.

18. The method of claim 1, wherein the height of a sight mount at the midpoint of the front side and the rear side is 2 mm to 5 mm.

19. The method of claim 1, wherein the height of a sight mount at the midpoint of the right side and the left side is 4 mm to 10 mm.

* * * * *